US008625394B2

(12) United States Patent
Kraft et al.

(10) Patent No.: US 8,625,394 B2
(45) Date of Patent: Jan. 7, 2014

(54) VARIABLE ALARM SOUNDS

(75) Inventors: Christian Kraft, Frederiksberg (DK); Peter D. Nielsen, Kgs Lyngby (DK); Kalle Ojala, Lempäälä, (FI)

(73) Assignee: Core Wireless Licensing S.a.r.l., Luxembourg (LU)

( * ) Notice: Subject to any disclaimer, the term of this patent is extended or adjusted under 35 U.S.C. 154(b) by 441 days.

(21) Appl. No.: 12/386,024

(22) Filed: Apr. 13, 2009

(65) Prior Publication Data

US 2009/0231964 A1 Sep. 17, 2009

Related U.S. Application Data

(63) Continuation-in-part of application No. 11/472,835, filed on Jun. 21, 2006, now abandoned.

(51) Int. Cl.
*G04C 21/16* (2006.01)

(52) U.S. Cl.
USPC ..... 368/251; 368/244

(58) Field of Classification Search
USPC ..... 368/12, 244, 250–251
See application file for complete search history.

(56) References Cited

U.S. PATENT DOCUMENTS

| | | | | |
|---|---|---|---|---|
| 6,539,395 | B1 | 3/2003 | Gjerdingen et al. | 707/102 |
| 6,678,215 | B1 | 1/2004 | Treyz et al. | 368/10 |
| 6,798,886 | B1 * | 9/2004 | Smith et al. | 381/61 |
| 7,468,934 | B1 * | 12/2008 | Janik | 368/13 |
| 2001/0004397 | A1 * | 6/2001 | Kita et al. | 381/334 |
| 2002/0099550 | A1 | 7/2002 | Emerick, Jr. | 704/270 |
| 2002/0181711 | A1 | 12/2002 | Logan et al. | 381/1 |
| 2002/0186618 | A1 * | 12/2002 | Kirkpatrick | 368/11 |
| 2003/0142591 | A1 | 7/2003 | Baweja et al. | 368/263 |
| 2005/0174889 | A1 * | 8/2005 | Marcantonio et al. | 368/12 |

(Continued)

FOREIGN PATENT DOCUMENTS

| | | | |
|---|---|---|---|
| EP | 1 589 385 | A2 | 10/2005 |
| GB | 2 296 346 | A | 6/1996 |

OTHER PUBLICATIONS

"Wake UP News", http://www.wakeupnews.com, Aug. 7, 2006, 7 pages.

(Continued)

*Primary Examiner* — Sean Kayes
(74) *Attorney, Agent, or Firm* — Ziegler IP Law Group, LLC

(57) ABSTRACT

Exemplary embodiments of the invention provide in an exemplary aspect thereof a method that includes storing data descriptive of a plurality of alarm sounds received from at least one source of alarm sounds, the stored data forming a set of alarm sounds; selecting an alarm sound from the set of alarm sounds; and playing the selected alarm sound at a predetermined time, where the selected alarm sound is one corresponding to data that was most recently stored. In another exemplary aspect of the invention a method includes, in response to a user input, enabling an alarm function and recording a current time of day; monitoring the time of day and activating the alarm function when the time of day is equal to a predetermined time of day; and making an alarm sound audible, where the alarm sound is selected from a set of alarm sounds based at least in part on a difference in time between the recorded time of day and the predetermined time of day.

15 Claims, 18 Drawing Sheets

(56) References Cited

U.S. PATENT DOCUMENTS

| | | | | |
|---|---|---|---|---|
| 2006/0280036 | A1* | 12/2006 | Hegarty | 368/73 |
| 2007/0057775 | A1 | 3/2007 | O'Reilly et al. | 340/309 |
| 2009/0073813 | A1* | 3/2009 | Stephens | 368/73 |

OTHER PUBLICATIONS

"MP3 Radio", http://users3.ev1.net/-randgreg/mp3__radio/Index.html, May 18, 2006.
"MP3 Radio", http://wwww.freedownloadscenter.com/Multimedia__and__Graphics/MPEG__Audio__Players__and__Editors/MP3__Radio.html,Aug. 8, 2006, 3 pages.
"Pandora",http://wwww.pandora.com/, Jun. 26, 2006, 3 pages.
"The Music Genome Project", (http://www.pandora.com/mgp.shtml), 1 page.
"MusicIP Mixer" (http://www.musicip.com/listener/, Jun. 26, 2006, 2 pages.
"MusicIP Mixer", (http://www.musicip.com/listener/mixer__tips), Jun. 26, 2006, 3 pages.
"MoodLogic", (http://www.moodlogic.com/), Jun. 26, 2006, 2 pages.
"MoodLogic", (http://www.moodlogic.com/mlnetwork-about.html), Jun. 26, 2006, 1 page.
"MoodLogic", (http://www.moodlogic.com/m120features.html), Jun. 26, 2006, 2 pages.
"Squeezebox/SqueezeNetwork", (http://www.slimdevices.com/pi__features.html), Jun. 26, 2006, 1 page.
"Squeezebox/SqueezeNetwork", (http://www.slimdevices.com/pi__overview.html), Jun. 26, 2006, 2 pages.
"Content-based Filtering System for Music Data", Kazuhiro Iwahama et al., IEEE 2004, 8 pages.
"Tagging introduction", (http://www.id3.org/intro.html), Jun. 8, 2006, 2 pages.
ID3v2 FAQ, (http://www.id3.org/faq.html), Jun. 8, 2006, 2 pages.

* cited by examiner

VARIABLE ALARM SOUNDS

CROSS-REFERENCE TO A RELATED US PATENT APPLICATION

This patent application is a continuation-in-part of U.S. patent application Ser. No. 11/472,835, filed Jun. 21, 2006, now abandoned which is incorporated by reference herein in its entirety.

TECHNICAL FIELD

The exemplary embodiments of this invention relate generally to alarm noises and sounds and, more specifically, relate to variable alarm noises and sounds.

BACKGROUND

Various devices, programs and services exist that enable a user to select and employ custom alarm sounds (e.g., alarm noises). A user may set a computer audio file (e.g. an mp3 file) or a radio station as an alarm sound to be played when an alarm clock goes off at a preset time. However, the selected alarm sound or noise is fixed, and is not variable or adaptive.

SUMMARY

In an exemplary embodiment of the invention, a method comprises storing data descriptive of a plurality of alarm sounds received from at least one source of alarm sounds, the stored data forming a set of alarm sounds; selecting an alarm sound from the set of alarm sounds; and playing the selected alarm sound at a predetermined time, where the selected alarm sound is one corresponding to data that was most recently stored.

In another exemplary embodiment of the invention there is a computer-readable memory that stores program instructions, the execution of which result in operations that comprise storing data descriptive of a plurality of alarm sounds received from at least one source of alarm sounds, the stored data forming a set of alarm sounds; selecting an alarm sound from the set of alarm sounds; and playing the selected alarm sound at a predetermined time, where the selected alarm sound is one corresponding to data that was most recently stored.

In another exemplary embodiment of the invention an apparatus comprises a controller configured with a memory to store data descriptive of a plurality of alarm sounds received from at least one source of alarm sounds, the stored data forming a set of alarm sounds. The controller is further configured to select an alarm sound from the set of alarm sounds and to play the selected alarm sound at a predetermined time, where the selected alarm sound is one corresponding to data that was most recently stored in the memory.

In another exemplary embodiment of the invention, a method comprises, in response to a user input, enabling an alarm function and recording a current time of day; monitoring the time of day and activating the alarm function when the time of day is equal to a predetermined time of day; and making an alarm sound audible, where the alarm sound is selected from a set of alarm sounds based at least in part on a difference in time between the recorded time of day and the predetermined time of day.

In another exemplary embodiment of the invention there is a computer-readable memory that stores program instructions, the execution of which result in operations that comprise, in response to a user input, enabling an alarm function and recording a current time of day; monitoring the time of day and activating the alarm function when the time of day is equal to a predetermined time of day; and making an alarm sound audible, where the alarm sound is selected from a set of alarm sounds based at least in part on a difference in time between the recorded time of day and the predetermined time of day.

In a further exemplary embodiment of the invention an apparatus comprises a controller configured with a clock to respond to a user input to enable an alarm function and record a current time of day. The controller is further configured to monitor the time of day and to activate the alarm function when the time of day is equal to a predetermined time of day. When activating the alarm function said controller makes an alarm sound audible, where the alarm sound is selected from a set of alarm sounds based at least in part on a difference in time between the recorded time of day and the predetermined time of day.

In a further exemplary embodiment of the invention, a method comprises monitoring at least a time of day; activating an alarm function when the time of day is equal to a predetermined time of day; and making an alarm sound audible, where the alarm sound is selected from a set of alarm sounds based at least in part on at least one of the predetermined time of day and a calendar date.

In another exemplary embodiment of the invention there is a computer-readable memory that stores program instructions, the execution of which result in operations that comprise monitoring a time of day, activating an alarm function when the time of day is equal to a predetermined time of day and making an alarm sound audible, where the alarm sound is selected from a set of alarm sounds based at least in part on at least one of the predetermined time of day and a calendar date.

In a further exemplary embodiment of the invention an apparatus comprises a controller configured with a clock to monitor a time of day and to activate an alarm function when the time of day is equal to a predetermined time of day, said controller being further configured to make an alarm sound audible, where the alarm sound is selected by said controller from a set of alarm sounds based at least in part on at least one of the predetermined time of day and a calendar date.

In another exemplary embodiment of the invention, a method comprises monitoring a time of day and a calendar date; activating an alarm function when the time of day is equal to a predetermined time of day and the calendar date is equal to a predetermined calendar date, where the predetermined time of day and predetermined calendar date are specified by an entry of an electronic calendar, the entry comprising associated note information; and making an alarm sound audible, where the alarm sound is selected from a set of alarm sounds based at least in part on a content of the note information.

In another exemplary embodiment of the invention there is a computer-readable memory that stores program instructions, the execution of which result in operations that comprise monitoring a time of day and a calendar date; activating an alarm function when the time of day is equal to a predetermined time of day and the calendar date is equal to a predetermined calendar date, where the predetermined time of day and predetermined calendar date are specified by an entry of an electronic calendar, the entry comprising associated note information; and making an alarm sound audible, where the alarm sound is selected from a set of alarm sounds based at least in part on a content of the note information.

In yet another exemplary embodiment of the invention an apparatus comprises a controller configured with a clock to monitor a time of day and a calendar date and to activate an alarm function when the time of day is equal to a predetermined time of day and the calendar date is equal to a predetermined calendar date. The predetermined time of day and predetermined calendar date are specified by an entry of an electronic calendar, where the entry comprises associated note information. The controller is further configured to make an alarm sound audible, where the alarm sound is selected by said controller from a set of alarm sounds based at least in part on a content of the note information.

In a further exemplary embodiment of the invention, a method comprises monitoring the time of day and activating an alarm function when the time of day is equal to a predetermined time of day; and selecting an alarm sound and making the selected alarm sound audible, where the alarm sound comprises a musical track having a desired intensity that is obtained from a radio receiver, and where selecting comprises automatically tuning the radio receiver until a station is received that is playing a musical track having the desired intensity.

In another exemplary embodiment of the invention there is a computer-readable memory that stores program instructions, the execution of which result in operations that comprise monitoring the time of day and activating an alarm function when the time of day is equal to a predetermined time of day; and selecting an alarm sound and making the selected alarm sound audible, where the alarm sound comprises a musical track having a desired intensity that is obtained from a radio receiver, and where selecting comprises automatically tuning the radio receiver until a station is received that is playing a musical track having the desired intensity.

In yet another exemplary embodiment of the invention an apparatus comprises a radio receiver and a controller configured with a clock and with the radio receiver to monitor a time of day and to activate an alarm function when the time of day is equal to a predetermined time of day. The controller is further configured to select an alarm sound and to make the selected alarm sound audible. The alarm sound comprises a musical track having a desired intensity that is obtained from the radio receiver, and the controller tunes the radio receiver until a station is received that is playing a musical track having the desired intensity.

BRIEF DESCRIPTION OF THE DRAWINGS

The foregoing and other aspects of embodiments of this invention are made more evident in the following Detailed Description, when read in conjunction with the attached Drawing Figures, wherein.

DETAILED DESCRIPTION

Many alarm clocks include a snooze function. When the alarm sounds, a user may employ the snooze function to have the alarm sound again a short time later (e.g. the alarm goes off again five or ten minutes later). In conjunction with the snooze function, conventional alarm clocks use the same alarm sound each time.

A user does not have the option of utilizing different alarm sounds for successive soundings of conventional alarm clocks. However, such utility would be desirable to provide a progressive means for a user to wake up. For example, the alarm sound of the alarm clock would initially be a gentle, soothing sound to peacefully wake the user. If the user hits the snooze button, successive soundings of the alarm would be less gentle, progressing to harsher alarm sounds. In such a manner, a user would wake up to an alarm clock in a progressive fashion, being presented with harsher, more severe alarm sounds the longer the user delays waking up (e.g. the more times the user presses the snooze button).

It would therefore be beneficial to provide a method, computer program product and device by which a user might employ different alarm sounds in a progressive nature.

Figure 1:
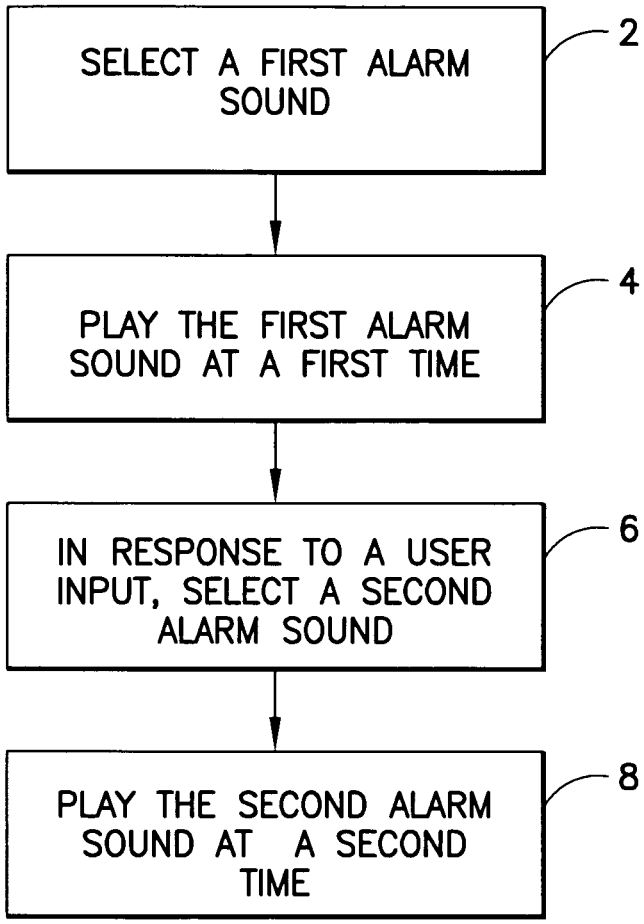
FIG. 1 shows a flowchart illustrating one non-limiting example of a method for practicing the exemplary embodiments of this invention.

Exemplary embodiments of the invention describe a methodology for providing variable alarm sounds. FIG. 1 shows a flowchart illustrating one non-limiting example of a method for practicing the exemplary embodiments of this invention. The method includes the following steps. In box 2, a first alarm sound is selected from a set of alarm sounds. As non-limiting examples, the set of alarm sounds may comprise a database or other collection of information relating to a plurality of sound data. The plurality of sound data may comprise a plurality of sound files, digital audio files (e.g. mp3 files), or radio signals (e.g. audio data received from one or more radio channels), as non-limiting examples. In other exemplary embodiments, the plurality of sound data may comprise a combination of different types of sound data (e.g. sound files, computer audio files, radio signals). The set of alarm sounds may comprise names of the sound data and characteristics of the associated sound data, as non-limiting examples. As further non-limiting examples of such characteristics, the set may comprise a beats per minute value, ID3 tag information, a genre, a category, an album name, a song title, an artist name, year, a track number and/or a length (e.g. time value). In box 4, the first alarm sound is played at a predetermined first time. In box 6, in response to a user input, a second alarm sound is selected from the same or a different set of alarm sounds. The second alarm sound is different from the first alarm sound. In box 8, the second alarm sound is played at a second time. The second time is chronologically after the first time. The latter two steps of the method, boxes 6 and 8, may be performed (e.g. repeated, iterated) for successive user inputs. In the case of such iterations, it may be desirable to employ different alarm sounds each time. However, different alarm sounds are not required for each iteration, so long as at least two different alarm sounds are utilized.

ID3 tag information refers to the ID3v1 and ID3v2 standards for appending information to digital audio files. ID3 tags may contain information relating to song title, artist name, album name, year and genre, as non-limiting examples. Although ID3v1 tags are only available in conjunction with the mp3 audio file format, ID3v2 is intended to operate in conjunction with audio files of other types as well. As used herein, "ID3 tag" and "ID3 tag information" refer to both the ID3v1 and ID3v2 standards. Other exemplary embodiments of the invention may utilize other standards or forms of information appended to or employed in conjunction with digital audio files.

In other exemplary embodiments, the plurality of sound data may comprise one or more audio channels associated with video files or broadcasts. As non-limiting examples, such a plurality of sound data may comprise a sound channel from one or more television stations, video tapes, digital video disks (DVDs), and/or digital video broadcasts (DVBs). In further embodiments wherein the first and/or second alarm sound comprises an audio channel associated with a video file or broadcast and the device playing the alarm sound (e.g. the alarm clock) has video capabilities, the associated video file or broadcast may be displayed in conjunction with the playing of the associated alarm sound.

Figure 2:
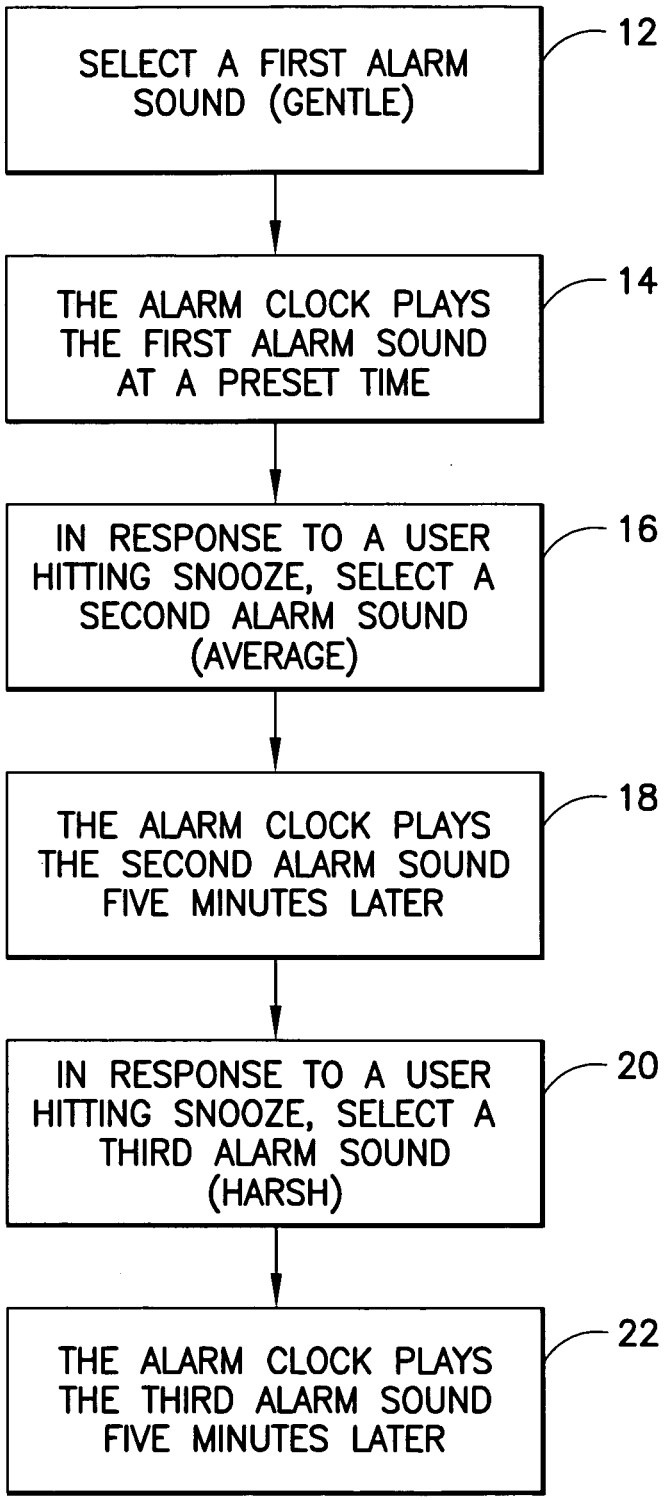
FIG. 2 shows a flowchart illustrating another non-limiting example of a method for practicing the exemplary embodiments of this invention.

The method illustrated in FIG. 1 may be employed in conjunction with an alarm clock function, as a non-limiting example. FIG. 2 shows a flowchart illustrating another non-limiting example of a method for practicing the exemplary embodiments of this invention. The method of FIG. 2 incorporates an alarm clock function having a snooze button. When a user hits the snooze button in response to the alarm clock sounding, the alarm clock is instructed to sound again five minutes later, thus enabling a user to "snooze" for five minutes. The method of FIG. 2 also incorporates a database of information (e.g. the set of alarm sounds) relating to mp3 files the user has selected to employ in conjunction with the alarm clock function. The database of FIG. 2 may also comprise a plurality of records, each record corresponding to a different mp3 file. Each record comprises a file name, title and category designation for the mp3 file. The category designation specifies a relative nature for each mp3 file by utilizing, for example, the three categories of gentle, average and harsh. The three categories correspond to a relative measure of the sound contained in the mp3 file as relating to a perceived nature of the sound, ranging from gentle (e.g. calm, peaceful) to harsh (e.g. raucous, piercing).

In general, these categories or measures may be considered to be descriptive of an 'intensity' of the sound, where a 'gentle' sound category or measure would be considered to have a lower intensity than a 'harsh' sound category or measure.

The method of FIG. 2 includes the following steps. In box 12, a first alarm sound is selected from the database (DB) by the variable alarm sound function (VAS). The first alarm sound comprises a first mp3 file having the gentle category designation. In box 14, the alarm clock function (AC) plays the first alarm sound at a preset time. This is the customary function of an alarm clock, to play an alarm sound at a preset time the user has specified so as to wake the user. In box 16, in response to a user hitting the snooze button on the AC, a second alarm sound is selected from the DB by the VAS. The second alarm sound comprises a second mp3 file having the average category designation. In box 18, the AC plays the second alarm sound five minutes after the preset time. In box 20, in response to a user hitting the snooze button on the AC, a third alarm sound is selected from the DB by the VAS. The third alarm sound comprises a third mp3 file having the harsh category designation. In box 22, the AC plays the third alarm sound five minutes after having played the second alarm sound (e.g. ten minutes after the preset time).

As is apparent, a user is presented with less gentle, harsher alarm sounds (higher intensity) for successive activations of the snooze function. In such a manner, different alarm sounds are employed in a progressive nature to wake the user.

Figure 3:
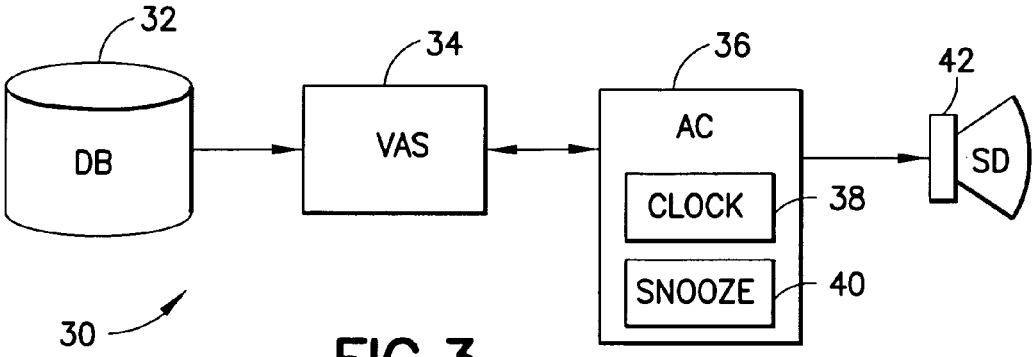
FIG. 3 depicts a block diagram illustrating the components employed in the method of FIG. 2.

FIG. 3 depicts a block diagram illustrating the components employed in the method of FIG. 2. The system 30 shown in FIG. 3 provides different alarm sounds to progressively wake a user. A database (DB) 32 is coupled to a variable alarm sound function (VAS) 34. The DB 32 is as explained above with regards to FIG. 2. The VAS 34 is coupled to an alarm clock function (AC) 36. The AC 36 comprises a clock 38 and a snooze function (snooze) 40. The clock 38 provides the AC 36 with the current time and enables the AC 36 to fulfill its alarm function by sounding an alarm sound at the appropriate time(s) (e.g. the preset time, for successive activations of the snooze function). The snooze function 40 may have functionality in accord with conventional implementations of snooze functions (e.g. a snooze button on an alarm clock) as explained above. The AC 36 is coupled to a sound device (SD) 42. The SD 42 is any device enabled to produce audible sound. A non-limiting example of a SD 42 is a speaker or any other type of device that transduces electrical energy to acoustic energy. In the system 30 of FIG. 3, the SD 42 produces sound corresponding to an alarm sound.

In other exemplary embodiments, the VAS 34 may be combined with the AC 36. In further embodiments, the AC 36 may be combined with the SD 42. In other exemplary embodiments, the VAS 34, AC 36 and SD 42 may be combined in one computer program product and/or device. In further embodiments, the clock 38 may be provided by an external entity to the AC 36.

Figure 4:
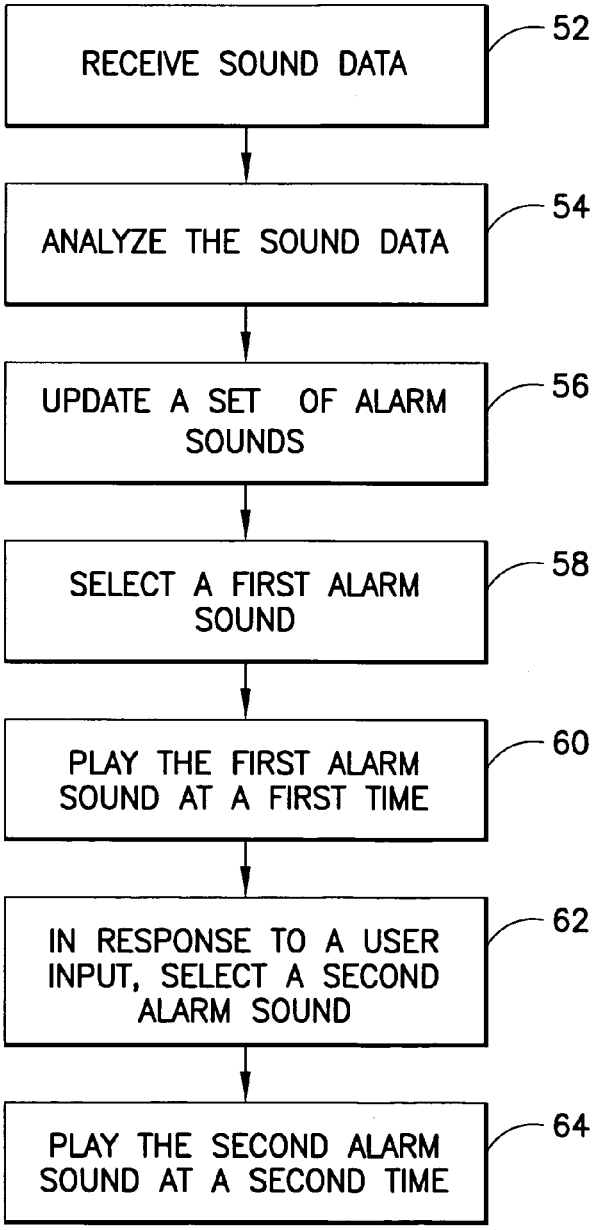
FIG. 4 shows a flowchart illustrating another non-limiting example of a method for practicing the exemplary embodiments of this invention.

FIG. 4 shows a flowchart illustrating another non-limiting example of a method for practicing the exemplary embodiments of this invention. The method includes the following steps. In box 52, sound data is received. The sound data may comprise a computer audio file, a computer audio signal or a radio signal, as non-limiting examples. In box 54, the sound data is analyzed. The analysis may comprise determining a beats per minute value (e.g. an average beats per minute for the sound data), reading ID3 tag information (e.g. if the sound data comprises a digital audio file having ID3 tag information, such as an mp3 file, as a non-limiting example), identifying the source of the sound data (e.g. person, animal, natural phenomenon, instruments), and/or analyzing the wave form (e.g. by utilizing spectral analysis), as non-limiting examples. In box 56, based on the analysis, a set of alarm sounds is updated. The set of alarm sounds may comprise a database or other collection of information, as non-limiting examples, and as further detailed above. In box 58, a first alarm sound is selected from the set of alarm sounds. Although in the embodiment of FIG. 4 the first alarm sound is selected from the same set of alarms sounds as the one updated in box 56, in other exemplary embodiments the first alarm sound may be selected from a different set of alarm sounds. In box 60, the first alarm sound is played at a predetermined first time. In box 62, in response to a user input (e.g. a user pressing a snooze button), a second alarm sound is selected from the set of alarm sounds. Although in the embodiment of FIG. 4 the second alarm sound is selected from the same set of alarms sounds as the one updated in box 56 and the one from which the first alarm sound was selected, in other exemplary embodiments the second alarm sound may be selected from a different set of alarm sounds. The second alarm sound is different from the first alarm sound. In box 64, the second alarm sound is played at a second time. The second time is chronologically after the first time. The first three steps, boxes 52, 54 and 56, are performed (e.g. repeated, iterated) for each item of sound data, as further illustrated in FIGS. 5 and 6.

Figure 5A:
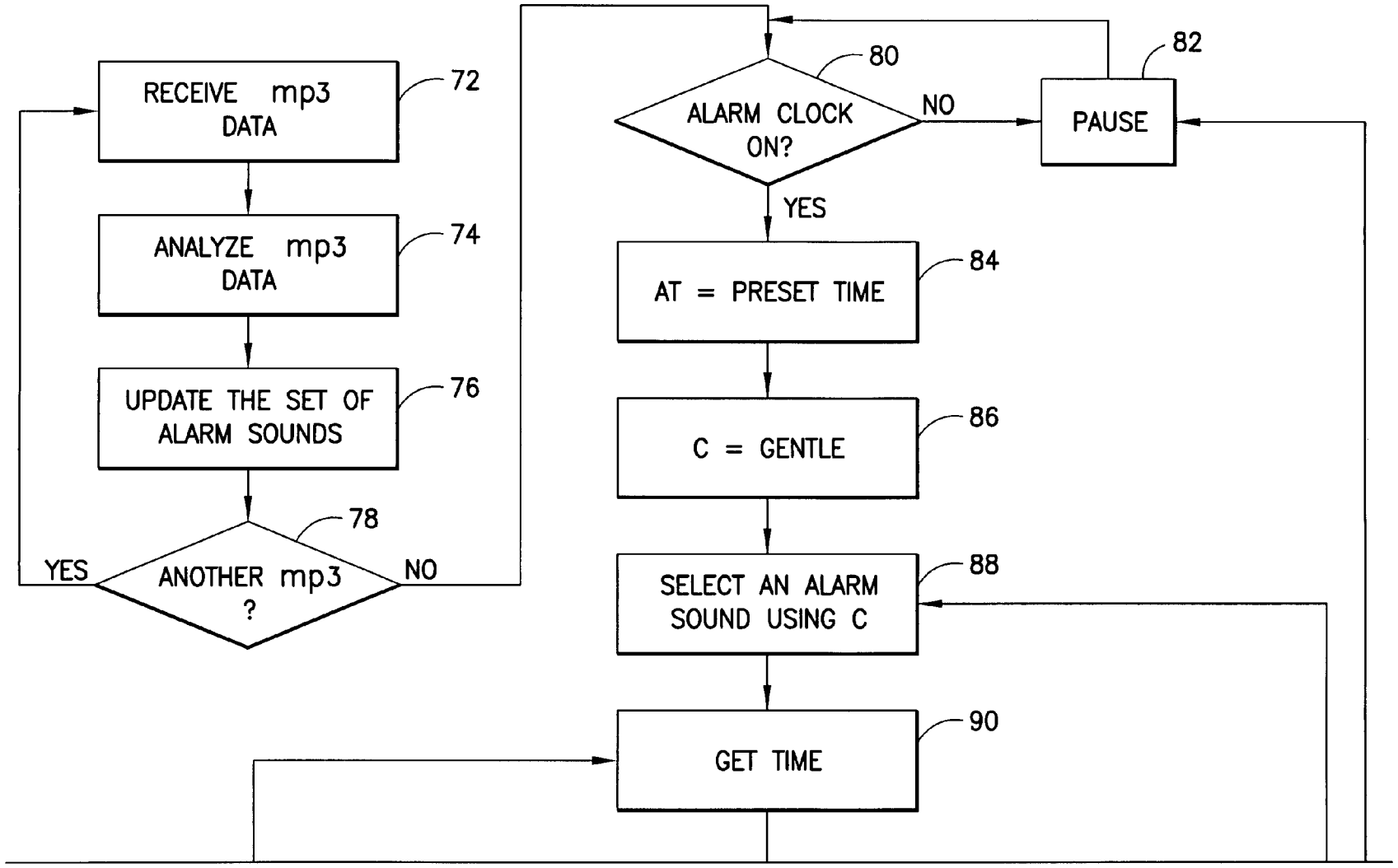
FIG. 5 shows a flowchart illustrating another non-limiting example of a method for practicing the exemplary embodiments of this invention.
Figures 5, 5A, 5B:
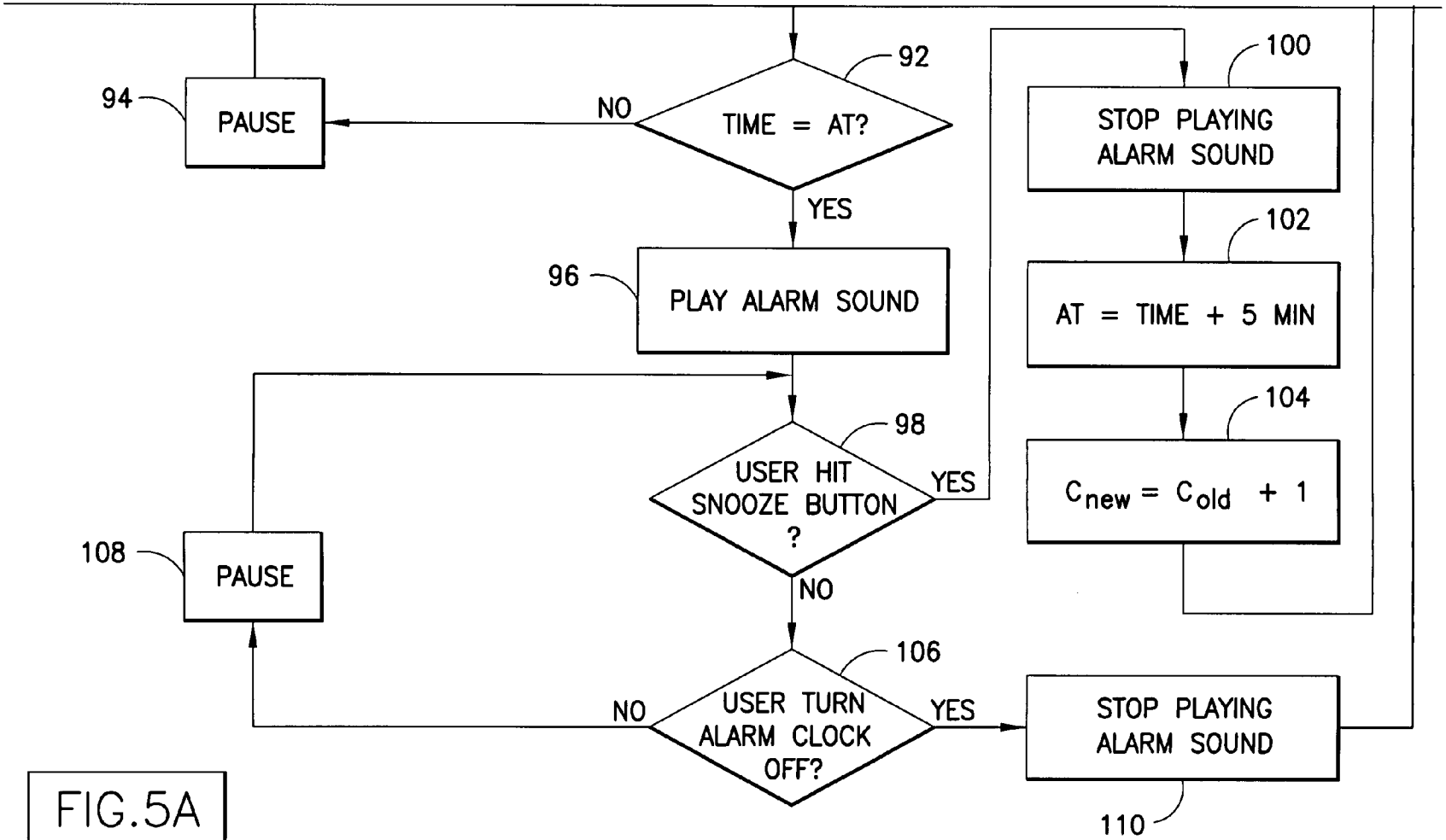

In other exemplary embodiments, the set of alarm sounds may be stored (e.g. updated) ahead of time (e.g. well before the first alarm sound is selected; see FIG. 5). In further embodiments, the set of alarm sounds may be updated in real time (e.g. immediately prior to selecting the first alarm sound; see FIG. 6). The real time updating of the set of alarm sounds may be particularly advantageous when employed in conjunction with sound data comprising one or more audio channels associated with a broadcast medium (e.g. radio signal, television station), as a non-limiting example. In such a usage and manner, the set of alarm sounds may better reflect the current one or more audio channels associated with the broadcast medium.

FIG. 5 shows a flowchart illustrating another non-limiting example of a method for practicing the exemplary embodiments of this invention. The method of FIG. 5 incorporates an alarm clock having a snooze button. When a user hits the snooze button in response to the alarm clock sounding, the alarm clock is instructed to sound again five minutes later. The method of FIG. 5 also incorporates a set of alarm sounds relating to mp3 files the user has selected to employ in conjunction with the alarm clock. The set of alarm sounds of FIG. 5 comprises a plurality of records, each record corresponding to a different mp3 file. Each record comprises a file name, title and category designation for the mp3 file. The category designation specifies a relative nature for each mp3 file, utilizing the three (exemplary) categories of gentle, average and harsh. The three categories correspond to a relative measure of the sound contained in the mp3 file as relating to a perceived nature of the sound, ranging from gentle (e.g. calm, peaceful) to harsh (e.g. raucous, piercing).

The method of FIG. 5 includes the following steps. In box 72, mp3 data is received. The mp3 data comprises one mp3 file of a plurality of mp3 files the user has selected to employ in conjunction with the alarm clock. In box 74, the mp3 data is analyzed to determine the file name, title and category for the mp3 file. In box 76, the set of alarm sounds is updated to include a record corresponding to the analyzed mp3 data. In box 78, the method inquires whether there is another mp3 file of the plurality of mp3 files that needs to be analyzed and included in the set of alarm sounds. If there is another mp3 file ("yes" to box 78), the method goes to box 72 and repeats boxes 72, 74 and 76 for the mp3 file to include it in the set of alarm sounds. If there is no other mp3 file ("no" to box 78), the method proceeds to box 80. In such a manner, steps 72, 74 and 76 are performed (e.g. repeated, iterated) for each mp3 file to be included in the set of alarm sounds. Furthermore, the set of alarm sounds is populated (e.g. updated) prior to any alarm clock functions or determinations. As such, the exemplary method of FIG. 5 is particularly advantageous when employed in conjunction with a plurality of sound data known in advance, such as user-specified audio files, as a non-limiting example.

In box 80 of FIG. 5, the method inquires whether the alarm clock is turned on. If the alarm clock is not turned on ("no"), the method pauses at box 82 before returning to box 80. The method repeats this loop until the alarm clock is turned on ("yes" to box 80) in which case the method moves to box 84. In box 84, the alarm time variable (AT) is set to a preset time the user has specified. In box 86, the category variable (C) is set to gentle. Boxes 84 and 86 set AT and C to their initial values as will be utilized for the first time the alarm clock goes off. In box 88, an alarm sound is selected from the set of alarm sounds using C. For the first time the alarm clock goes off, C is set to gentle and an mp3 having the gentle designation is selected as the first alarm sound. In box 90, the method obtains the current time (Time). In box 92, the method inquires whether Time=AT. That is, the method asks whether it is time for the alarm clock to go off. If it is not time ("no"), the method pauses at box 94 before returning to box 90. The method repeats the loop of boxes 90, 92 and 94 until it is time for the alarm clock to go off (e.g. Time=AT). The method then proceeds to box 96 where the alarm sound is played. In box 98, the method inquires whether a user, in response to the alarm sound being played, has hit the snooze button. If a user hits the snooze button ("yes"), the method moves to box 100 where it stops playing the alarm sound. In box 102, AT is set to equal five (5) minutes from the current time (Time). In box 104, C is incremented by one degree if possible. For example, if C was set to gentle, it is incremented by one degree and has a new value of average. If C was set to average, it is incremented by one degree and has a new value of harsh. If C was set to harsh, it is not incremented since there is no higher value. The method then returns to box 88. In such a manner, the new values for AT and C will be employed to select a new alarm sound and have the alarm clock go off at a new time. If a user does not hit the snooze button ("no" to box 98), the method moves to box 106. In box 106, the method inquires whether the user has turned the alarm clock off. If a user has not turned the alarm clock off ("no"), the method pauses at box 108 before returning to box 98. If a user has turned the alarm clock off ("yes"), the method moves to box 110 where it stops playing the alarm sound. The method then pauses at box 82 before returning to box 80. In such a manner, the alarm sound continues to be played, perhaps even looping, until a user either hits the snooze button ("yes" to box 98) or turns the alarm clock off ("yes" to box 106).

In other exemplary embodiments, the initial value of C (e.g. gentle in FIG. 5) may be user-defined. In further embodiments, sound data other than mp3s may be utilized in conjunction with the exemplary method illustrated in FIG. 5. However, as noted above, the exemplary method of FIG. 5 is particularly advantageous when employed in conjunction with a plurality of sound data known in advance since the set of alarm sounds is populated (e.g. updated) prior to any alarm clock functions or determinations.

Figure 6A:
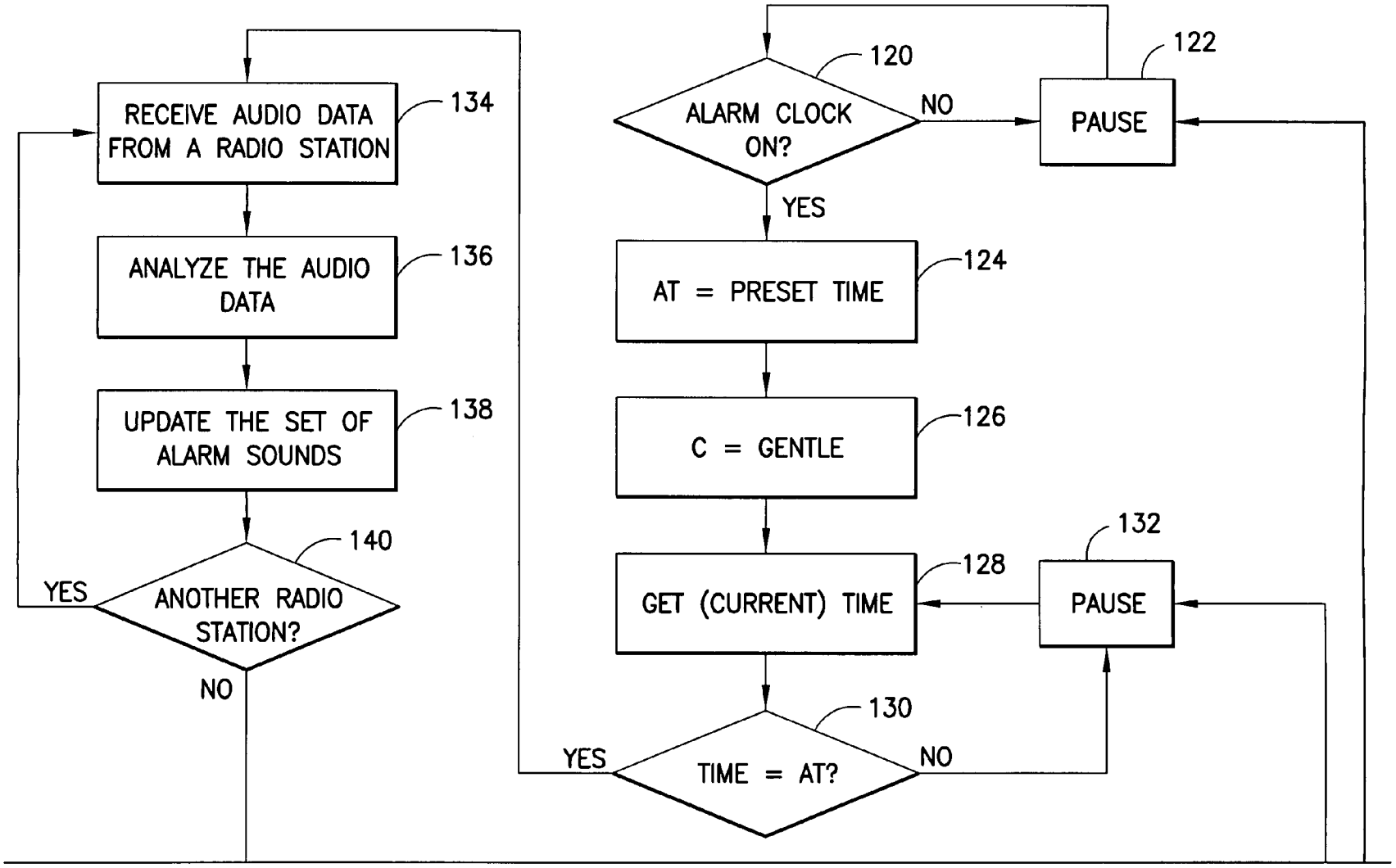
FIG. 6 shows a flowchart illustrating another non-limiting example of a method for practicing the exemplary embodiments of this invention.
Figures 6, 6A, 6B:
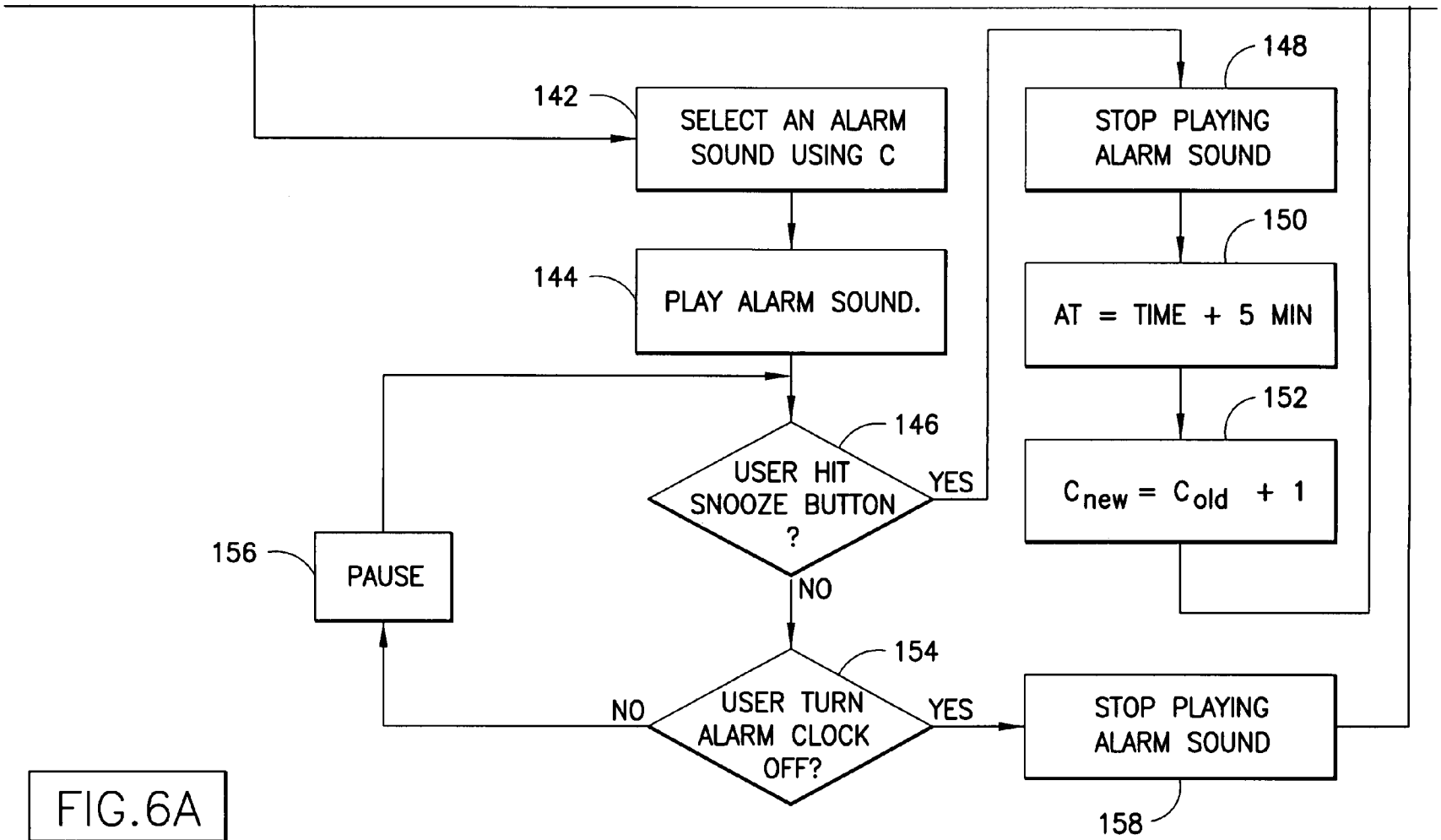

FIG. 6 shows a flowchart illustrating another non-limiting example of a method for practicing the exemplary embodiments of this invention. The method of FIG. 6 incorporates an alarm clock having a snooze button. When a user hits the snooze button in response to the alarm clock sounding, the alarm clock is instructed to sound again five minutes later. The method of FIG. 6 also incorporates a set of alarm sounds relating to a plurality of radio stations the user has selected to employ in conjunction with the alarm clock. The set of alarm sounds of FIG. 6 comprises a plurality of records, each record corresponding to a different radio station. Each record comprises a radio station name, radio station FM frequency and category designation. The category designation specifies a relative nature for each radio station, utilizing the three categories of gentle, average and harsh. The three categories correspond to a relative measure of the sound analyzed from the radio station as relating to a perceived nature of the sound, ranging from gentle (e.g. calm, peaceful) to harsh (e.g. raucous, piercing).

The method of FIG. 6 includes the following steps. In box 120, the method inquires whether the alarm clock is turned on. If the alarm clock is not turned on ("no"), the method pauses at box 122 before returning to box 120. The method repeats this loop until the alarm clock is turned on ("yes" to box 120) in which case the method moves to box 124. In box 124, the alarm time variable (AT) is set to a preset time the user has specified. In box 126, the category variable (C) is set to gentle. Boxes 124 and 126 set AT and C to their initial values as will be utilized for the first time the alarm clock goes off. In box 128, the method obtains the current time (Time). In box 130, the method inquires whether Time=AT. That is, the method asks whether it is time for the alarm clock to go off. If it is not time ("no"), the method pauses at box 132 before returning to box 128. The method repeats the loop of boxes 128, 130 and 132 until it is time for the alarm clock to go off (e.g. Time=AT).

Once it is time for the alarm clock to go off (e.g. Time=AT; "yes" to box 130), the method proceeds to box 134. In box 134, audio data is received from a radio station. The radio station is one of the radio stations from the plurality of radio stations the user previously selected to employ in conjunction with the alarm clock. In box 136, the audio data is analyzed to determine the current category designation. In box 138, the set of alarm sounds is updated to include the current category designation for the analyzed audio data. In box 140, the method inquires whether there is another radio station of the plurality of radio stations that needs to be analyzed. If there is another radio station ("yes" to box 140), the method goes to box 134 and repeats boxes 134, 136 and 138 for the next radio station. If there is no other radio station ("no" to box 140), the method proceeds to box 142. In such a manner, steps 134, 136 and 138 are performed (e.g. repeated, iterated) for each radio station to be included in the set of alarm sounds. Furthermore, the set of alarm sounds is updated in response to the alarm clock going off (e.g. in real time). As such, the exemplary method of FIG. 6 is particularly advantageous when employed in conjunction with a plurality of audio channels associated with one or more broadcast mediums (e.g. radio, television).

In box 142, an alarm sound is selected from the set of alarm sounds using C. For the first time the alarm clock goes off, C is set to gentle and a radio station currently having the gentle designation is selected as the first alarm sound. The method then proceeds to box 144 where the alarm sound is played. In box 146, the method inquires whether a user, in response to the alarm sound being played, has hit the snooze button. If a user hits the snooze button ("yes"), the method moves to box 148 where it stops playing the alarm sound. In box 150, AT is set to equal five (5) minutes from the current time (Time). In box 152, C is incremented by one degree if possible. For example, if C was set to gentle, it is incremented by one degree and has a new value of average. If C was set to average, it is incremented by one degree and has a new value of harsh. If C was set to harsh, it is not incremented since there is no higher value. The method then moves to box 132 where it pauses before returning to box 128. In such a manner, the new values for AT and C will be employed to have the alarm clock go off at a new time and to select a new alarm sound. If a user does not hit the snooze button ("no" to box 146), the method moves to box 154. In box 154, the method inquires whether the user has turned the alarm clock off. If a user has not turned the alarm clock off ("no"), the method pauses at box 156 before returning to box 146. If a user has turned the alarm clock off ("yes"), the method moves to box 158 where it stops playing the alarm sound. The method then pauses at box 122 before returning to box 120. In such a manner, the alarm sound continues to be played, perhaps even looping, until a user either hits the snooze button ("yes" to box 146) or turns the alarm clock off ("yes" to box 154).

In other exemplary embodiments, the initial value of C (e.g. gentle in FIG. 6) may be user-defined. In further embodiments, sound data other than audio data associated with radio stations may be utilized in conjunction with the exemplary method illustrated in FIG. 6. However, as noted above, the exemplary method of FIG. 6 is particularly advantageous when employed in conjunction with a plurality of audio channels associated with one or more broadcast mediums (e.g. radio, television). In other exemplary embodiments, radio stations having FM or AM frequencies may be utilized. In further embodiments, the plurality of radio stations may comprise a user-specified range of frequencies. In other exemplary embodiments, the plurality of radio stations may comprise the entire spectrum of radio station frequencies.

Although illustrated in FIG. 6 with respect to radio stations, the exemplary method of FIG. 6 may be employed in conjunction with other broadcast medium (e.g. television), non-broadcast medium (e.g. mp3 files) and/or a combination thereof, as non-limiting examples.

Figure 7:
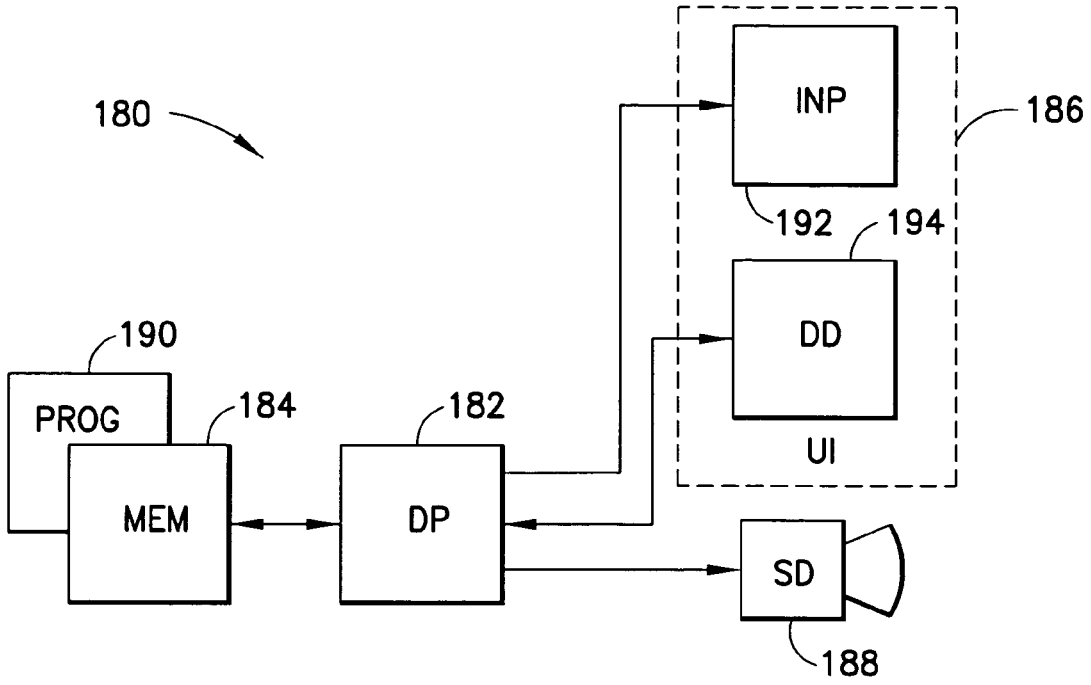
FIG. 7 depicts a simplified block diagram of an electronic device that is suitable for use in practicing the exemplary embodiments of this invention.

Reference is made to FIG. 7 for illustrating a simplified block diagram of an electronic device, such as a computer or an alarm clock having digital capabilities, suitable for use in practicing the exemplary embodiments of this invention. In FIG. 7, the electronic device 180 includes a data processor (DP) 182, a memory (MEM) 184 coupled to the DP 182, a user interface (UI) 186 coupled to the DP 182, and a sound device (SD) 188 coupled to the DP 182. The MEM 184 stores program code (PROG) 190. The UI 186 comprises at least one input device (INP) 192 and an optional display device (DD) 194. The INP 192 may comprise a push button, as a non-limiting example. The SD 188 is a speaker or any other type of device that transduces electrical energy to acoustic energy. The PROG 190 is assumed to include program instructions that, when executed by the DP 182, enable the electronic device 180 to operate in accordance with the exemplary embodiments of this invention, as discussed above in greater detail.

Figure 8:
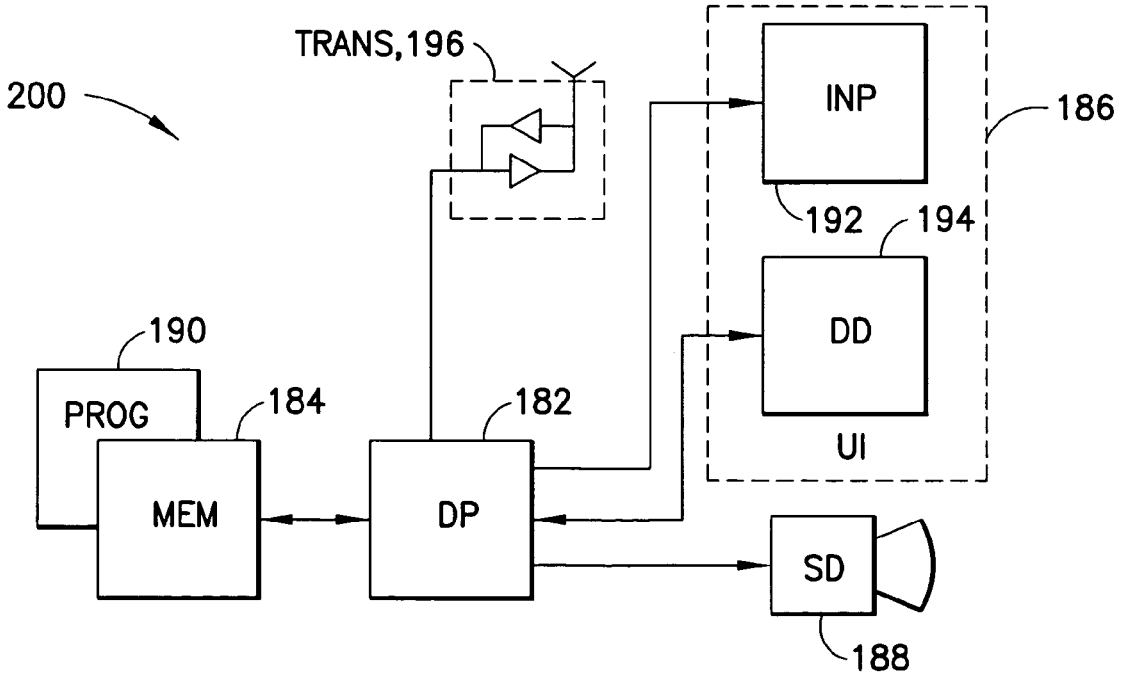
FIG. 8 depicts a simplified block diagram of another electronic device that is suitable for use in practicing the exemplary embodiments of this invention.

Reference is made to FIG. 8 for illustrating a simplified block diagram of another electronic device that is suitable for use in practicing the exemplary embodiments of this invention. In FIG. 8, the electronic device 200 includes a data processor (DP) 182, a memory (MEM) 184 coupled to the DP 182, a user interface (UI) 186 coupled to the DP 182, a sound device (SD) 188 coupled to the DP 182, and a transceiver (TRANS) 196 coupled to the DP 182. The MEM 184 stores program code (PROG) 190. The UI 186 comprises at least one input device (INP) 192 and an optional display device (DD) 194. The INP 192 may comprise a push button, as a non-limiting example. The SD 188 is a speaker or any other type of device that transduces electrical energy to acoustic energy. The PROG 190 is assumed to include program instructions that, when executed by the DP 182, enable the electronic device 180 to operate in accordance with the exemplary embodiments of this invention, as discussed above in greater detail. The TRANS 196 enables the electronic device to communicate, via a wired or wireless connection, with other electronic devices. The connection may be direct (e.g. device to device via a direct connection) or through various intermediaries (e.g. service providers, over the Internet, via one or more networks such as a local area network (LAN), wireless network, or cellular network, as non-limiting examples), as non-limiting examples.

The MEM 184 may be of any type suitable to the local technical environment and may be implemented using any suitable data storage technology, such as semiconductor based memory devices, magnetic memory devices and systems, optical memory devices and systems, fixed memory and removable memory, as non-limiting examples. The DP 182 may be of any type suitable to the local technical environment, and may include one or more of general purpose computers, special purpose computers, microprocessors, digital signal processors (DSPs) and processors based on a multicore processor architecture, as non-limiting examples.

In other exemplary embodiments, the electronic device 180 of FIG. 7 and/or the electronic device 200 of FIG. 8 may additionally comprise a battery, other power source (e.g. solar cell), or a power source connection (e.g. AC adapter, wire for connection to a wall plug).

If including a battery or other power source, the electronic device may be a portable electronic device. In general, the various embodiments of such a portable electronic device can include, but are not limited to, cellular telephones, personal digital assistants (PDAs), portable computers, image capture devices such as digital cameras, gaming devices, music storage and playback appliances (e.g., mp3 players), Internet appliances permitting wireless Internet access and browsing, as well as portable units or terminals that incorporate combinations of such functions.

Figure 9:
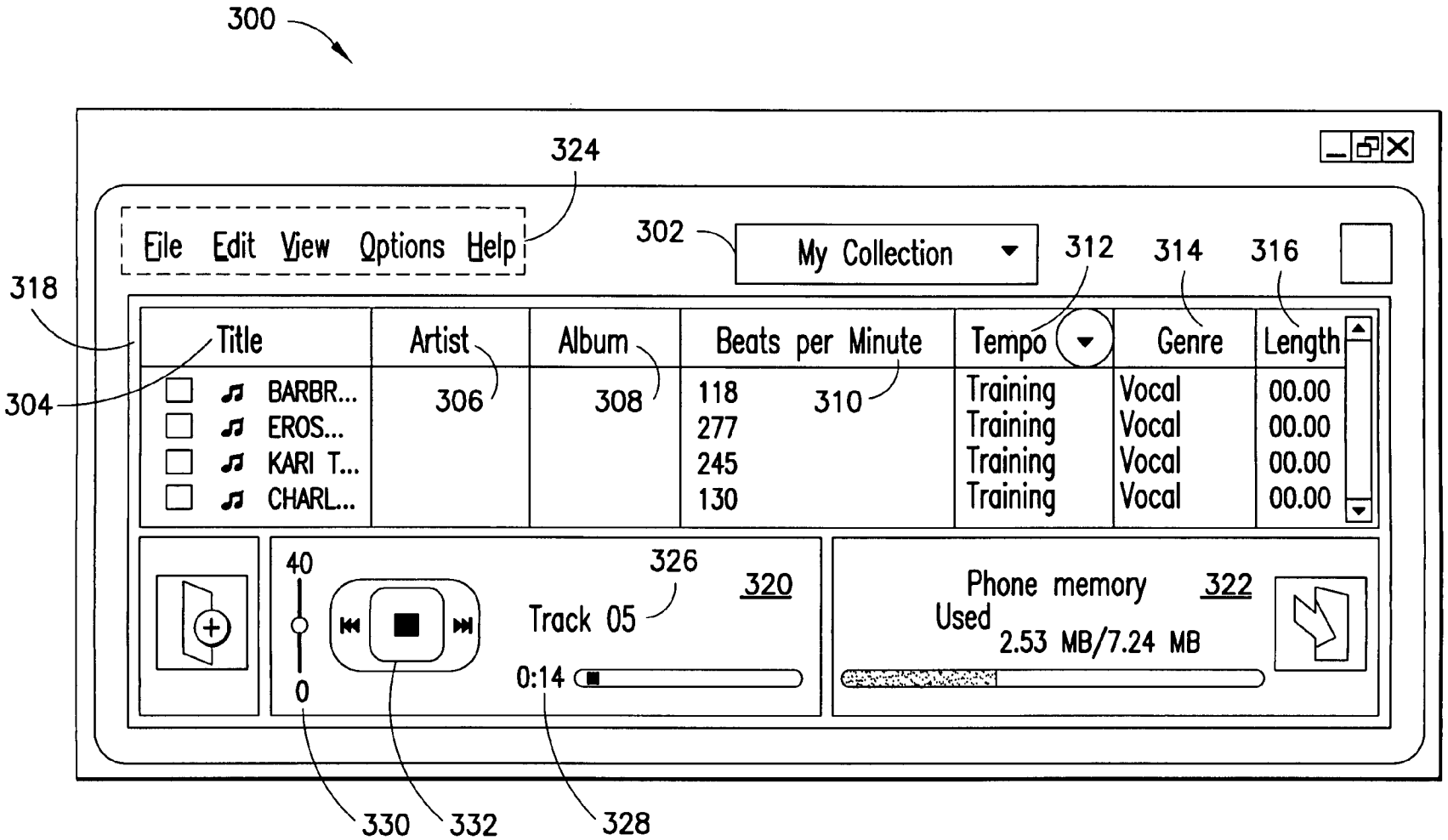
FIG. 9 illustrates an exemplary graphical user interface (GUI) that may be employed in conjunction with exemplary embodiments of the invention.

In conjunction with the exemplary embodiments of FIGS. 1-8, and other exemplary embodiments of the invention, a graphical user interface (GUI) may be employed. The GUI would enable a user to more easily interact with the various method steps and/or components (e.g. components of a computer program product, components of an electronic device). FIG. 9 illustrates an exemplary GUI 300 that may be employed in conjunction with exemplary embodiments of the invention. Although shown below with one exemplary GUI, any suitable user interface (UI), graphical or non-graphical, may be employed with exemplary embodiments of the invention. Furthermore, in other exemplary embodiments, other suitable GUIs may be employed other than the one shown below. In further embodiments, the UI employed in conjunction with exemplary embodiments of the invention may be designed to function in accordance with an operating system.

In FIG. 9, the GUI 300 enables a user to manage a collection of mp3 files (e.g. sound data) in conjunction with a cell phone. The GUI 300 enables a user to create and manage a playlist of mp3 files.

The playlist shown in FIG. 9 is entitled "My Collection," as shown in a playlist title box 302. The GUI 300 displays information about the constituent mp3 files of My Collection, including the title of the song 304, the artist 306, the album 308, a beats per minute value (BPM) 310, a tempo indication 312, a genre 314, and a length (e.g. duration of the song) 316. Category labels corresponding to the categories of available information are displayed in a category bar 318.

The GUI 300 further comprises a play function 320, a phone memory display 322, and a set of pull-down menus 324. The play function 320 allows a user to preview the collection of mp3 files by listening to the mp3 files. The play function 320 of FIG. 9 comprises a track number display 326, a time display 328, a volume control 330, and a set of track controls 332. The track number display 326 shows the track number currently being played by the play function 320. The time display 328 shows the current play time for the track being played (e.g. how far into the track, as measured in time, the current playing of the track is). The volume control 330 enables a user to raise or lower the volume of the play function 320. The set of track controls 332 provide a user with a selection of controls for playing the tracks in the collection, such as controls for: moving to the previous track, moving to the next track, playing the track using the play function, and stopping the playing of the track by the play function, as non-limiting examples. The phone memory display 322 shows the current usage of the cell phone's memory (e.g. storage). The phone memory display 322 assists a user in determining how much room is available on the cell phone for additional mp3s (e.g. whether a user can add mp3s to the collection). The set of pull-down menus 324 provide a user with additional options such as options for: create new playlist, save playlist, open playlist, copy playlist to phone, loop playlist, and random play (e.g. play the tracks in the playlist in a random order), as non-limiting examples. The GUI 300 is assumed to operate in accordance with the exemplary embodiments of the invention, as discussed herein. As one non-limiting example, the GUI may enable a user to at least select an alarm sound from a set of alarm sounds.

In other exemplary embodiments, the GUI may enable a user to manage a collection of sound data comprising types of sound data other than mp3 files (e.g. wav files). In further embodiments, different categories of available information may be utilized. In other exemplary embodiments, the GUI may not comprise a play function, a phone memory display, and/or a set of pull-down menus. In further embodiments, a user can sort the mp3 files in the collection by interacting (e.g. left clicking, right clicking, using a contextual menu) with the category labels shown in the category bar. In other exemplary embodiments, the information (e.g. metadata) associated with each mp3 file (e.g. sound data) may be contained within each corresponding mp3 file (e.g. each item of sound data). As a non-limiting example, ID3 tags may be employed to provide and/or retain the desired information.

In other exemplary embodiments, a manager program may be employed. The manager program may be an application for managing mobile music on a computer or a mobile device (e.g. cellular telephone, mp3 player, portable gaming device). Using the manager program, a user can convert music files and transfer the tracks to a mobile device. Metadata may be included in the files created with the manager program. The metadata may contain information such as artist, genre and song title information, as non-limiting examples. With the manager program a user can also compose playlists. The playlists may be created on a computer or a mobile device, as non-limiting examples. For example, a user can create a playlist on a computer and transfer it to a mobile device. As an additional non-limiting example, a user can create a playlist directly on the mobile device, perhaps by using the manager program.

The manager program may display BPM and tempo information by default when certain mobile devices are connected to the computer running the manager program. The manager program may read the BPM from a database of music information (e.g. Gracenote®) or calculate the BPM itself, as non-limiting examples. The manager program may write the BPM in the metadata of the music file.

The tempo value comprises the BPM multiplied by a user selectable value. As a non-limiting example, a user may be able to select between two settings: Run and Walk. Each setting has a preset user selectable value. Furthermore, each setting corresponds to a different exercise type (e.g. running, walking). Thus, between the two settings a user may choose one of two values that correspond to an exercise type and subsequently affects the tempo values (e.g. by affecting the user selectable value that the BPM multiplied by). The tempo values may not be stored in the files (e.g. in the metadata) but rather may be recalculated when they are displayed.

The tempo value describes the pace of the music track. As a non-limiting example, four tempo values may be employed, namely: training, stretching, cooling, and warm up. In training exercises it is usually important to have and maintain an appropriate pace. Using the tempo as a selection or definition criteria, a user can define the training pace as indicated by the music tracks being played (e.g. according to the music the user is listening to). Each tempo value corresponds to a training pace. In such a manner, the training pace of the workout of the user may be set by the music the user is listening to (e.g. the tempo of the music). The four exemplary tempo values may be ordered, from lowest pace to highest pace as: stretching, cooling, warm up, and training. The order is a relative one that generally corresponds to a desired relative order of the training pace for the four activities. For example, usually the pace of a workout when a user is warming up (e.g. in a warm up phase of a workout) is greater than the pace of a workout when a user is stretching or cooling off ("cooling"). As such, the music defining the pace of a workout may reflect the pace by the tempo value of the music.

A user can organize the music and playlists according to tempo values (e.g. training, stretching, cooling, warm up). As previously explained, the tempo values are mapped from the BPM and the setting (e.g. Run, Walk) affects the tempo value. As a non-limiting example of such a mapping as it relates to the selected setting, for the Walk setting the stretching tempo may comprise BPM values of 33-59 BPM while for the Run setting the stretching tempo may comprise BPM values of 60-107 BPM. In this example, the Run setting will result in faster tempos than the Walk setting to correlate to the faster pace of a workout under the Run setting. As further examples of such a mapping, for the Walk setting, the cooling tempo may comprise BPM values of 60-80 BPM, the warm up tempo may comprise BPM values of 81-106 BPM, and the training tempo may comprise BPM values of 107-138 BPM. For the Run setting, the cooling tempo may comprise BPM values of 108-122 BPM, the warm up tempo may comprise BPM values of 123-137 BPM, and the training tempo may comprise BPM values of 138-180 BPM.

The BPM may be calculated from each music track automatically. The BPM may be utilized to automatically generate a corresponding tempo value. The BPM may be stored to music file metadata for later usage while the tempo value may be re-calculated by the manager program based on the BPM information in the metadata.

Using this method, a user does not need to manually evaluate the pace and/or tempo of each music track. Once a tempo value is calculated for one or more music tracks, a user can sort the music files according to the tempo values and select appropriate music to listen to during a workout. In other exemplary embodiments, appropriate music may be suggested for a user to listen to during a workout.

The GUI 300 of FIG. 9 may be utilized with an exemplary manager program as described immediately above. In such a use, the tempo value for each mp3 file would be dependent on the BPM of the mp3 file. Furthermore, in such an exemplary embodiment in which the two settings of Run and Walk are employed, the tempo value would also be dependent on the Run/Walk setting.

Figure 10:
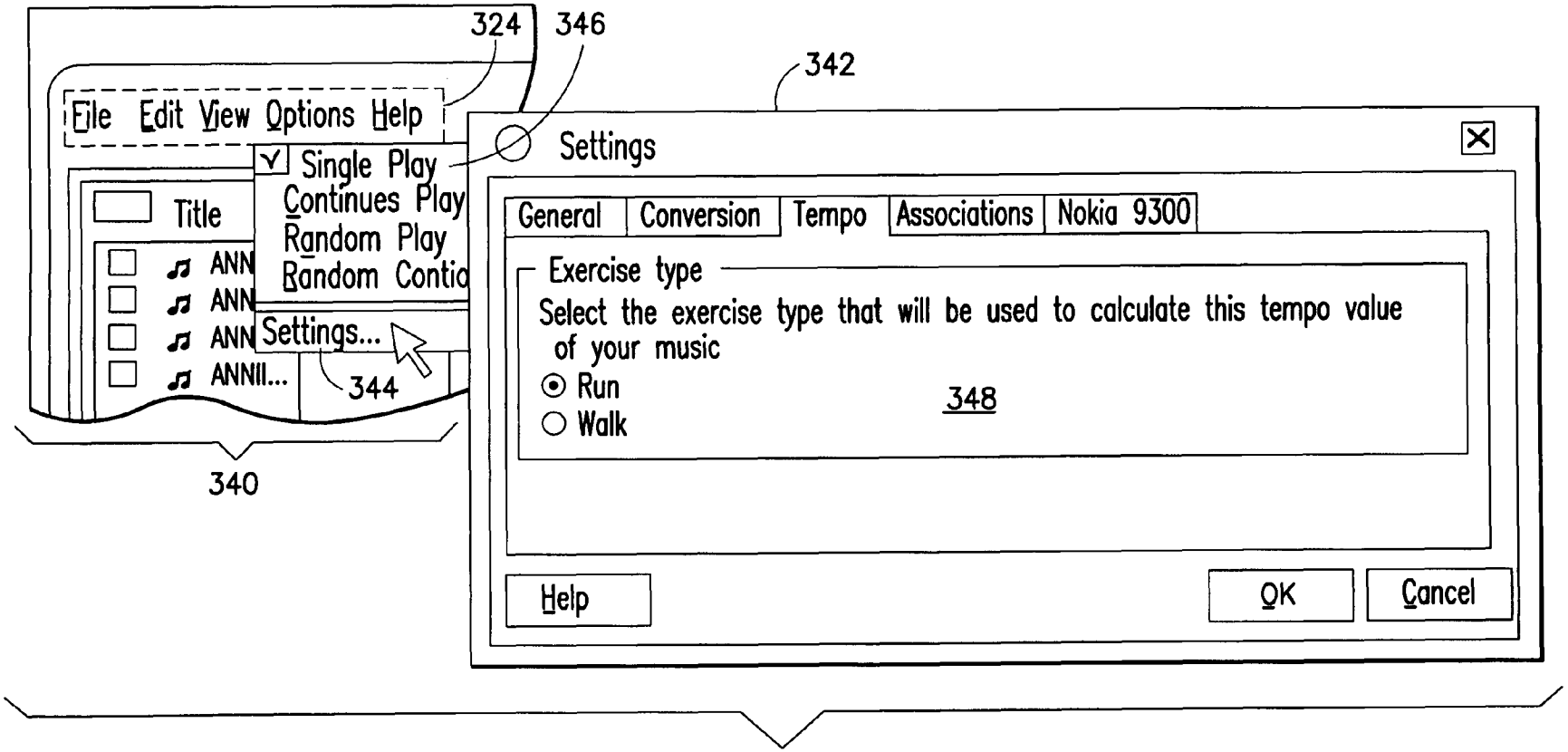
FIG. 10 depicts a portion of the GUI of FIG. 9 and a settings dialogue in an exemplary manager program embodiment of the invention.

FIG. 10 depicts a portion 340 of the GUI 300 of FIG. 9 and a settings dialogue 342 in an exemplary manager program embodiment of the invention, as discussed immediately above. The settings dialogue 342 of FIG. 10 is accessed by selecting the "Settings" option 344 in the Options pull down menu 346. The settings dialogue 342 comprises an "Exercise type" option 348 in which a user can select either the Run setting or the Walk setting.

Figure 11:
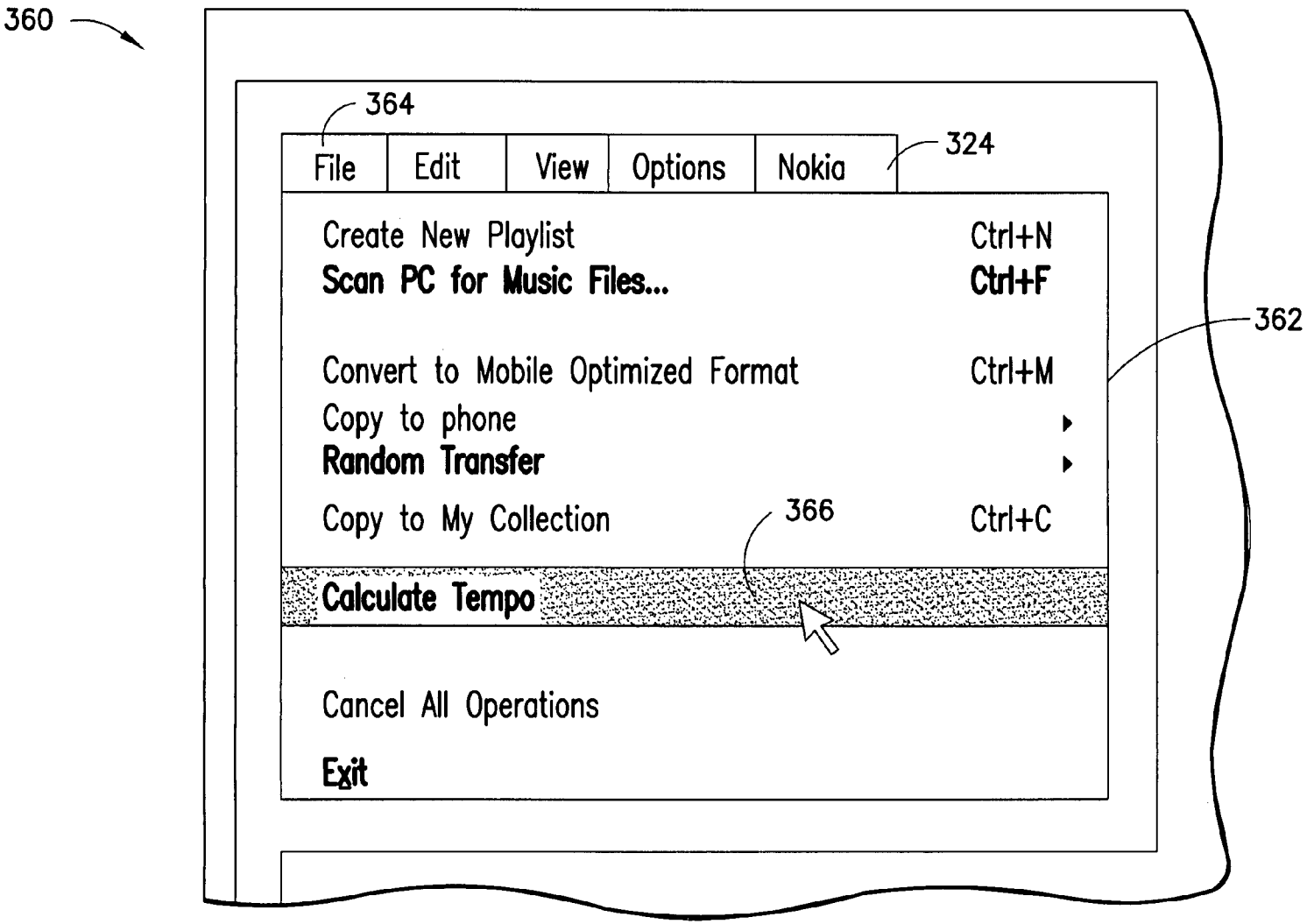
FIG. 11 depicts a portion of a GUI in another exemplary manager program embodiment of the invention.

FIG. 11 depicts a portion 360 of a GUI in another exemplary manager program embodiment of the invention. In FIG. 11, a user has opened the file pull down menu 362 by clicking on the "File" label 364 in the set of pull down menus 324. In the file pull down menu 362 is a calculate tempo option 366. The calculate tempo option 366 has the manager program calculate the BPM for one or more music tracks (e.g. mp3 files). The calculate tempo option may be particularly useful in calculating the BPM for music files that do not contain BPM information in the file metadata. In other exemplary embodiments, the calculate tempo option may not be provided or may be accessible by different means (e.g. a keyboard shortcut, located in a different pull down menu). In further embodiments, the calculate tempo option may also write the BPM information in the metadata of the respective analyzed file(s).

Figure 12:
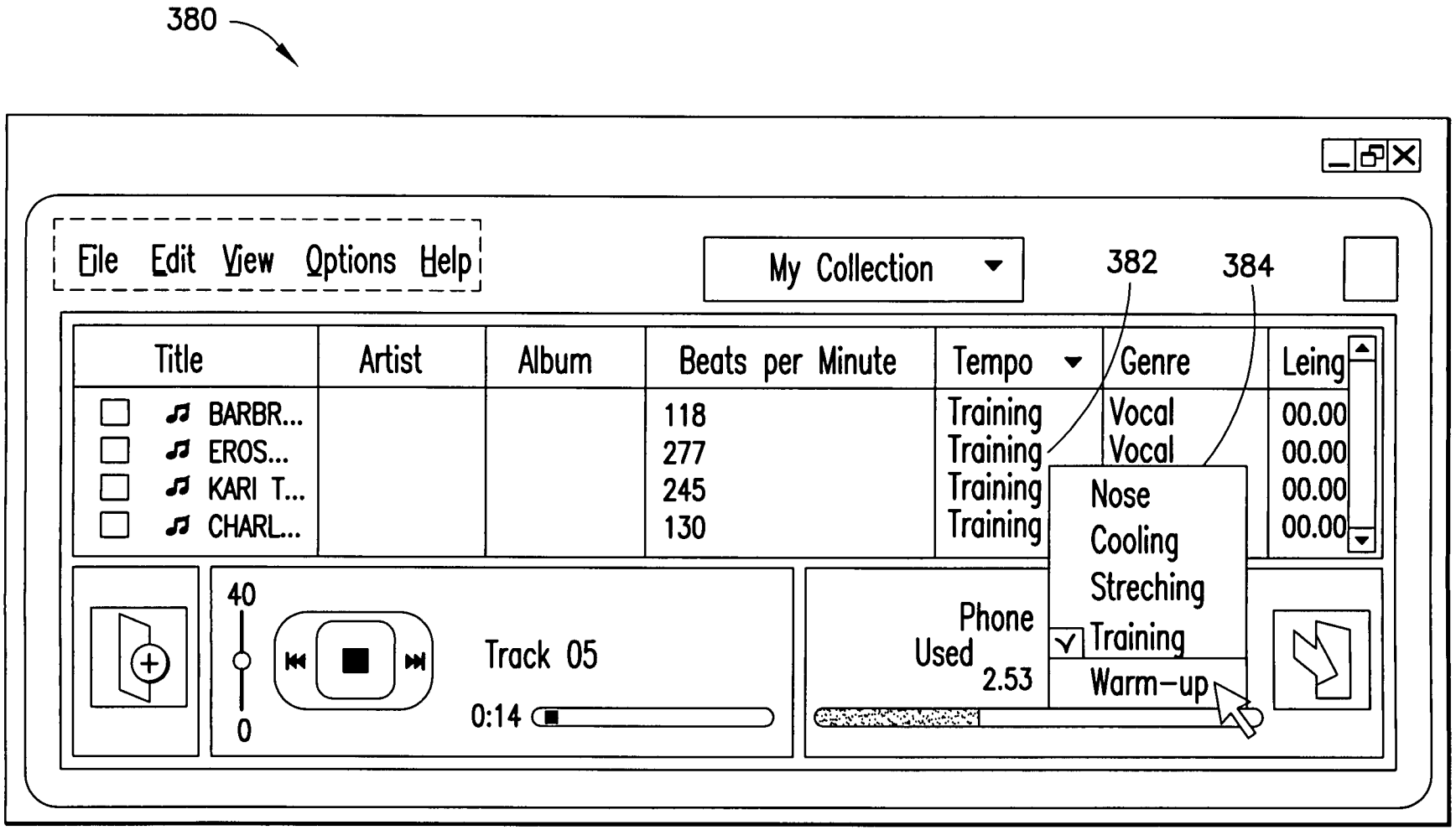
FIG. 12 depicts a GUI for an exemplary manager program in which the tempo value is a user-defined value.

In other exemplary embodiments, a user may specify the tempo value associated with a music track. In such a manner, the tempo value may not be explicitly related to the BPM of the music track. Furthermore, the tempo value of such an embodiment may be stored in the metadata of the music track since the tempo value is no longer dependent on the BPM value (e.g. the tempo value is now a user-defined value). FIG. 12 depicts a GUI 380 for an exemplary manager program in which the tempo value is a user-defined value. In the GUI 380, a user has right-clicked on the tempo value 382 corresponding to the EROS song, thus opening a contextual menu 384. Currently, the tempo value 382 is set to Training. However, the user may select a different tempo value to associate with the EROS song. In other exemplary embodiments, a contextual menu may not be provided. In further embodiments, the available tempo values may comprise a different number of values and/or different values. In other exemplary embodiments, the contextual menu may comprise additional options (e.g. open tempo options). In further embodiments, a user may access the contextual menu by a different method (e.g., by shift left-clicking).

Figure 13:
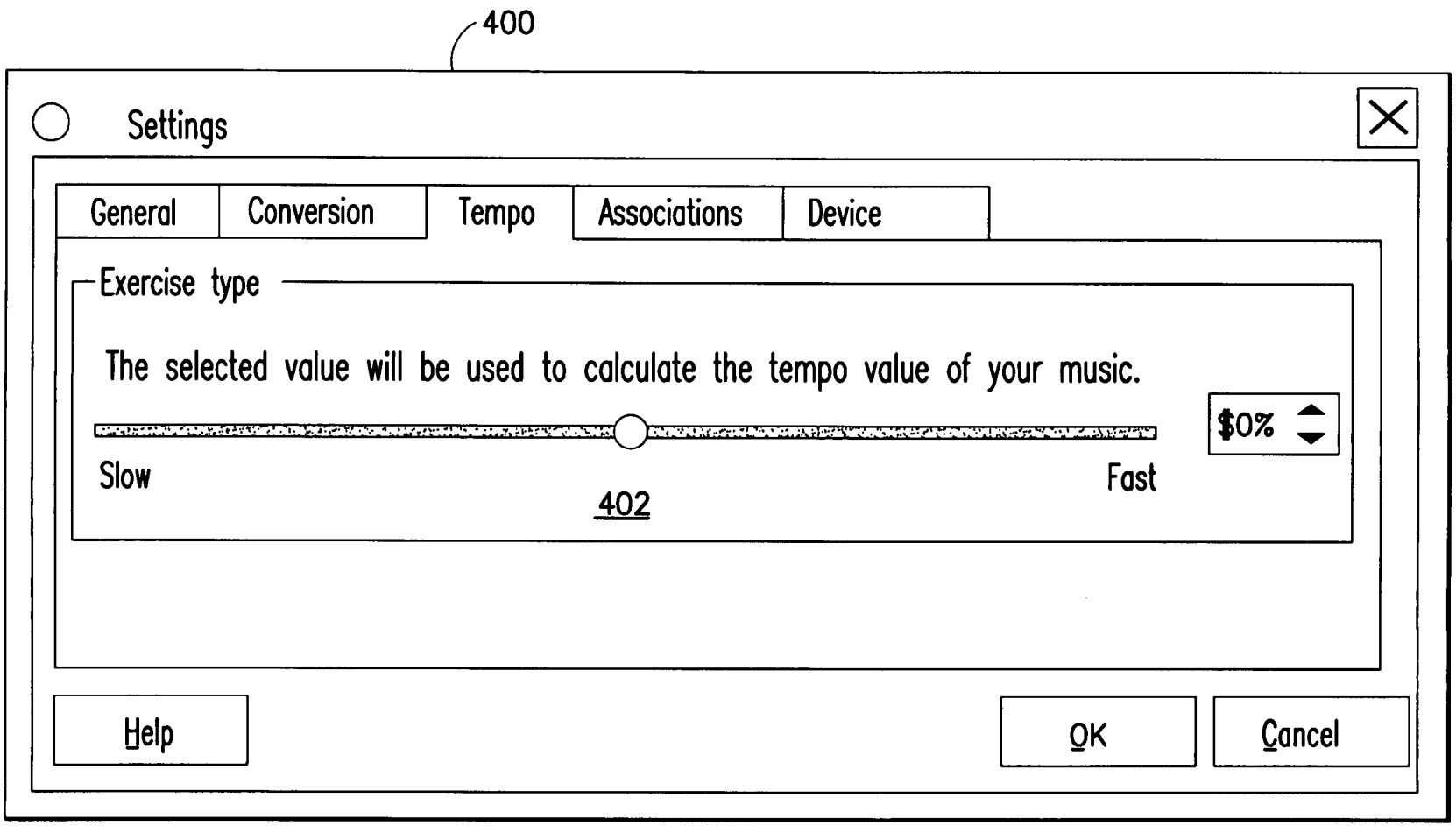
FIG. 13 depicts an exemplary settings dialogue in an alternate exemplary embodiment of the invention.

FIG. 13 depicts an exemplary settings dialogue 400 in an alternate exemplary embodiment of the invention. The settings dialogue 400 has an "Exercise type" option 402 in which a user can specify the selected value to be used in calculating the tempo values of the music files. In the exemplary settings dialogue 400 of FIG. 13, the selected value is expressed as a percent multiplier (e.g. 50%) ranging from slow (e.g. less than 50%) to fast (e.g. greater than 50%). The selected value may be set for different values for different music files, similar to the Run/Walk setting discussed above. In other exemplary embodiments, a different selected value (e.g. other than the Run/Walk setting, other than the percent multiplier of FIG. 13) may be utilized.

If embodied as an electronic device, the structure of such manager program embodiments may be similar or identical to the structure of the embodiments described above with respect to FIGS. 7 and 8.

As can be appreciated from the foregoing, exemplary aspects of the manager program embodiment provide a method, computer program product and device that enable a user to utilize a tempo value of one or more music tracks (e.g. music files) to select appropriate and/or desired music tracks to listen to when performing various activities (e.g. exercising). The tempo value may be set by the user or the tempo value may be based on a mathematical relationship utilizing the beats per minute value (BPM) of the one or more music tracks. As a non-limiting example, the tempo value may be determined by multiplying the BPM by a user selectable value. As a further non-limiting example, the user selectable value may be based on one or more selected activities and/or activity types (e.g. running, walking).

The manager program embodiment may be employed in conjunction with the variable alarm sounds. As a non-limiting example, the tempo values may be utilized by an alarm clock function to provide variable alarm sounds. An alarm sound having a lower tempo value may be employed as the first alarm sound. Subsequent alarm sounds would be chosen based on the tempo value of the alarm sounds such that the tempo value of each successive alarm sound is greater than the tempo value of the previous alarm sound. In such a manner, a user would wake up to an alarm clock in a progressive fashion, being presented with faster tempo alarm sounds the longer the user delays waking up (e.g. the more times the user presses the snooze button or activates a snooze function). When employed in conjunction with the variable alarm sounds, it may be preferable to enable a user to define his or her own tempo values to be used with the manager program embodiment. Consequently, the alarm sounds would not be limited to default ones but rather a user could define intermediary steps, allowing for a user-defined progression when waking up using the exemplary embodiments of the invention.

Described now are even further exemplary and non-limiting embodiments of this invention, with reference to FIGS. 14-20.

Figure 14:
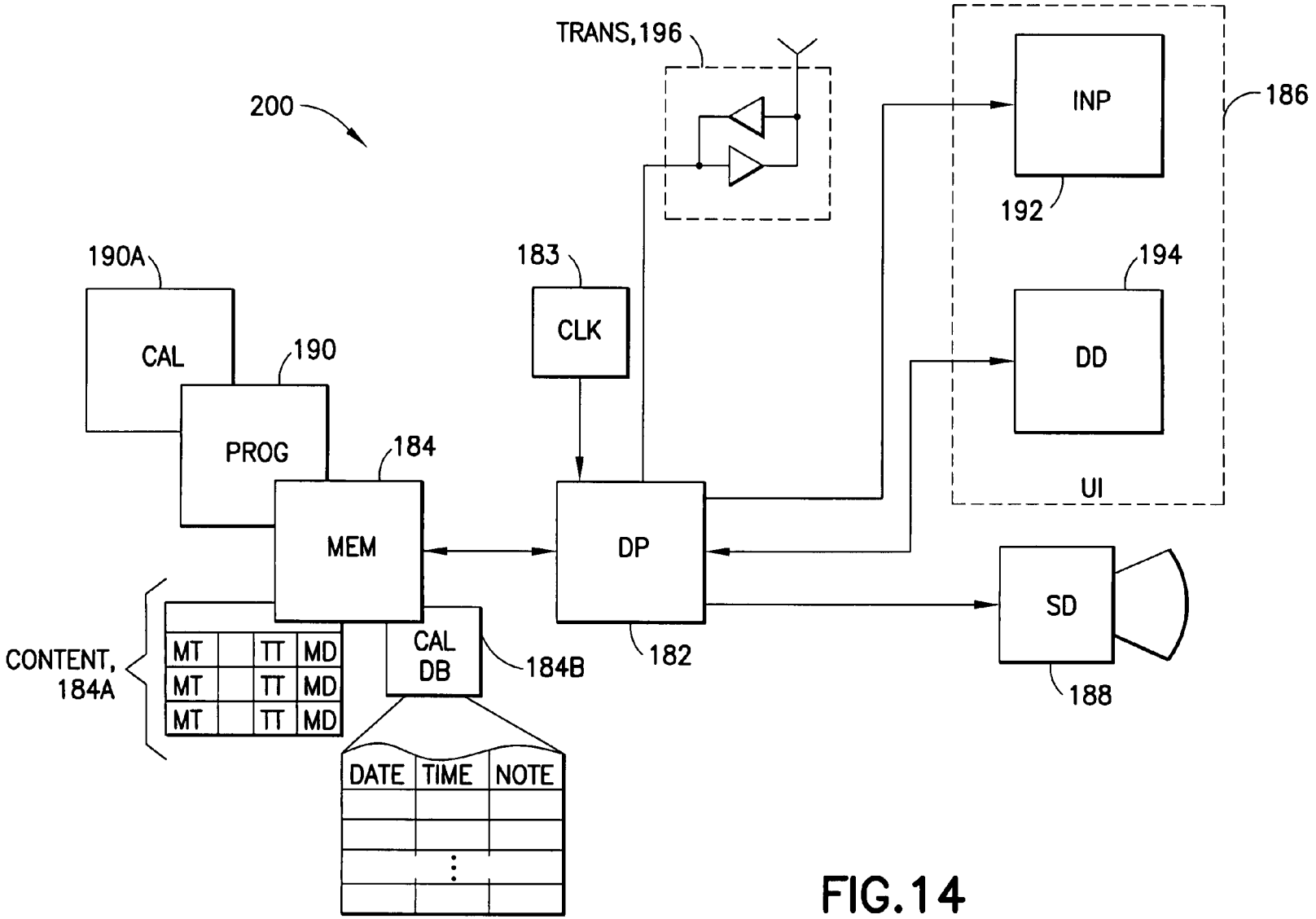
FIGS. 14 and 15 each depict a simplified block diagram of an electronic device that is also suitable for use in practicing the exemplary embodiments of this invention.

In a first exemplary further embodiment, and referring to FIG. 14, the memory 184 stores content 184A, such as downloaded music tracks (MTs) each having associated therewith a time tag (TT) indicating the time when the music track was downloaded via, as a non-limiting example, the TRANS 196. The electronic device 200 includes a clock (CLK) function 183 that provides, for example, the current time of day and calendar date. The PROG 190, when selecting a music track to play as an alarm sound, automatically selects the music track having associated therewith a time tag indicating a most-recently downloaded music track. If a second music track is to be played at the end of playing the first music track, then the PROG 190 may select a next-most recently downloaded music track, and so forth.

Figure 16:
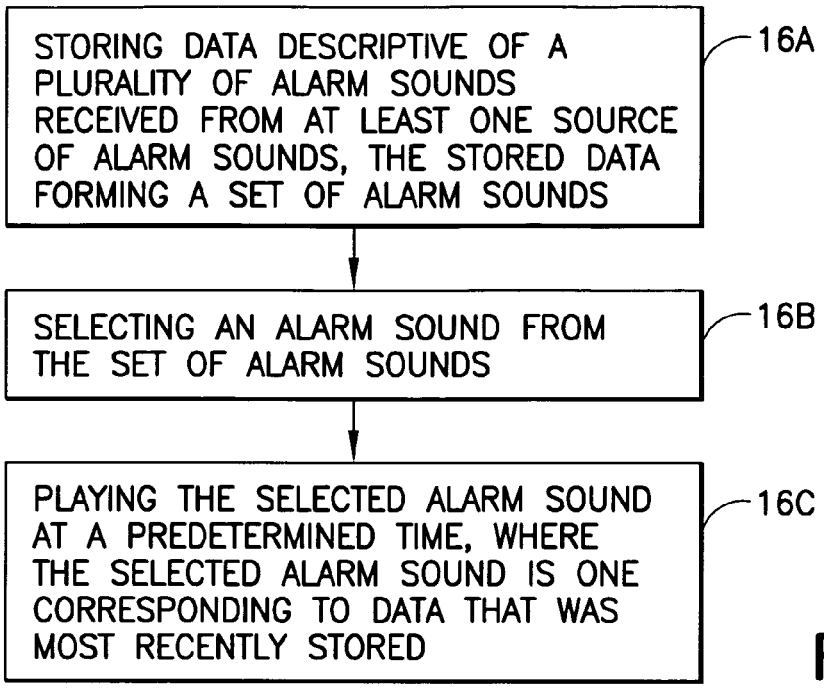
FIGS. 16-20 are each a logic flow diagram illustrating the operation of a method, and a result of execution of computer program instructions embodied on a computer readable memory, in accordance with the exemplary embodiments of this invention.

As can thus be appreciated, the exemplary embodiments of this invention encompass a method, computer program stored in a memory, and an apparatus that provide, as in FIG. 16, (Block 16A) storing data descriptive of a plurality of alarm sounds received from at least one source of alarm sounds, the stored data forming a set of alarm sounds; (Block 16B) selecting an alarm sound from the set of alarm sounds; and (Block 16C) playing the selected alarm sound at a predetermined time, where the selected alarm sound is one corresponding to data that was most recently stored.

In the foregoing method, computer program and apparatus, the set of alarm sounds comprises a database comprising received sound data, wherein the received sound data may comprise digital audio files, and where at least some of the digital audio files comprise an mp3 file. For example, the received sound data may comprise a digital audio file having ID3 tag information.

In another exemplary further embodiment, and referring again to FIG. 14, the PROG 190 is arranged such that a 'default' intensity of the alarm clock sound is a function of an amount of time (which may be referred to for convenience as '$\Delta T$') between the time at which the user activates the alarm function and the preset wake-up time. In other words, for those users who set the alarm when going to sleep the alarm sound intensity is a function of the amount of time that the user can actually sleep. In this manner a more intense alarm sound may be used if the user has had, for example, only four hours to sleep as opposed to if the user has had eight hours to sleep. This mode of operation facilitates waking up the user when the user has had less sleep.

In this embodiment a 'more intense' alarm sound may imply a higher volume and/or a selection of an alarm sound or music track that is more energetic (e.g., faster tempo) than a 'less intensive' alarm sound (e.g., hard rock versus soft rock).

Figure 17:
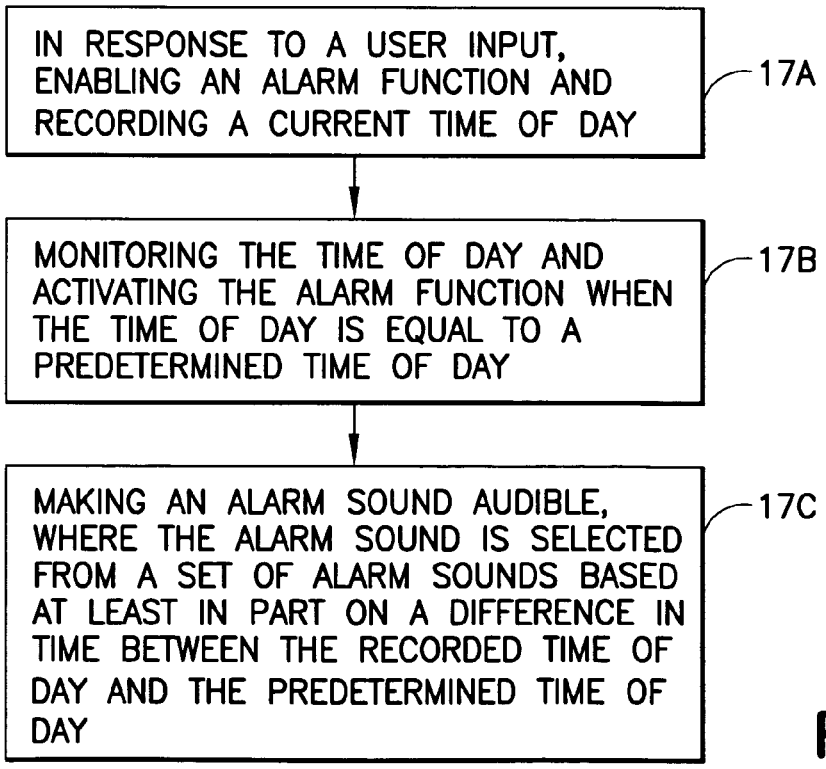

As can thus be appreciated, the exemplary embodiments of this invention also encompass a method, computer program stored in a memory, and an apparatus that provide, as in FIG. 17, (Block 17A) in response to a user input, enabling an alarm function and recording a current time of day; (Block 17B) monitoring the time of day and activating the alarm function when the time of day is equal to a predetermined time of day; and (Block 17C) making an alarm sound audible, where the alarm sound is selected from a set of alarm sounds based at least in part on a difference in time between the recorded time of day and the predetermined time of day.

In the foregoing method, computer program and apparatus, where an intensity of the selected alarm sound is inversely proportional to the difference between the recorded time of day and the predetermined time of day.

In another exemplary further embodiment, and referring again to FIG. 14, the PROG 190 is arranged to select an alarm sound (e.g., one of the MTs stored in the memory 184) as a function of the time of day and/or date. For example, a selected alarm sound for the evening may contain a phrase such as "good evening", and an alarm sound that is activated on a particular holiday may be selected to be a musical piece associated with that holiday. In this case there may be metadata (MD) associated with all or some of the individual items of content 184A, such as the musical tracks stored in the memory 184, where the metadata includes any information that facilitates the selection of the associated musical track based on time and/or date (e.g., title, lyrics, type of music (e.g., Christmas carol, National anthem) and so forth).

Figure 18:
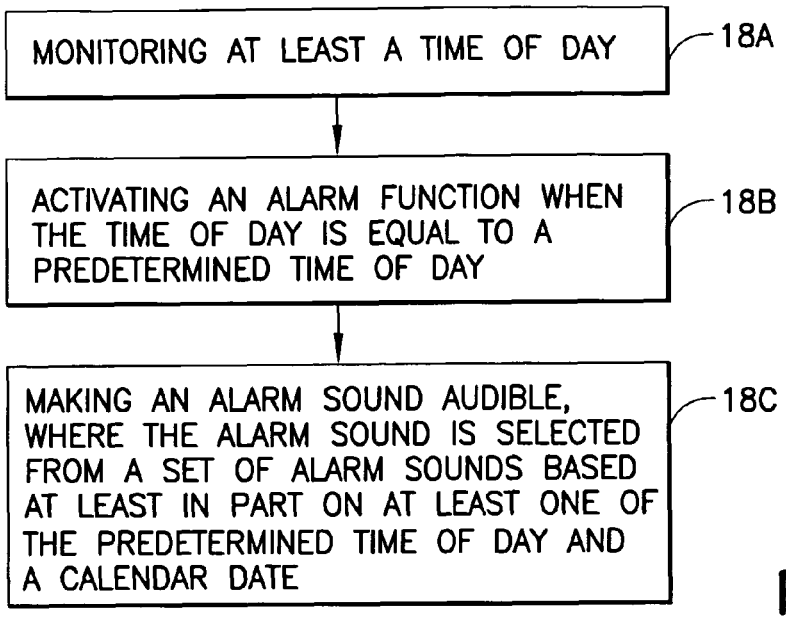

As can thus be appreciated, the exemplary embodiments of this invention also encompass a method, computer program stored in a memory, and an apparatus that provide, as in FIG. 18, (Block 18A) monitoring at least a time of day; (Block 18B) activating an alarm function when the time of day is equal to a predetermined time of day; and (Block 18C) making an alarm sound audible, where the alarm sound is selected from a set of alarm sounds based at least in part on at least one of the predetermined time of day and a calendar date.

In the foregoing method, computer program and apparatus, where individual members of the set of alarm sounds comprise digital audio data and associated metadata, where the alarm sound is further selected in accordance with a relationship between the metadata and the at least one of the predetermined time of day and the calendar date.

In another exemplary further embodiment the PROG 190 is arranged to select an alarm sound (e.g., one of the MTs stored in the memory 184) as a function of an alarm triggered by a calendar (CAL) function 190A having an associated calendar database (CAL DB) 184B. In the calendar database 184B is stored a data structure organized in some suitable manner based on calendar dates, times and associated notes. For example, a typical calendar database record may be similar to the date/time/note tuple: Aug. 6, 2009; 10:00 AM; Meeting with staff". In this embodiment the PROG 190 may be adapted to automatically analyze the content of a particular calendar note stored in the calendar database 184B, and then use the analyzed content to select an appropriate alarm sound when annunciating that particular calendar alert. As one non-limiting example, if the calendar note contains the word 'yellow', the calendar function 190A, in cooperation with the PROG 190, may automatically select as an alarm sound or indication a musical track containing the word 'yellow' in the title (e.g., "Yellow Submarine" by the Beatles). As another non-limiting example, if the calendar note entry for a certain date states 'anniversary, don't forget to buy flowers', the PROG 190 may automatically select as an alarm tone a musical track "The Wedding March", or another musical track having as a part of the metadata a text string such as "our wedding song", or "her favorite song", etc. This latter example may assume that the user is enabled to specify and/or modify the metadata associated with a particular musical track, such as by using the graphical user interface 300 shown in FIG. 9.

Figure 19:
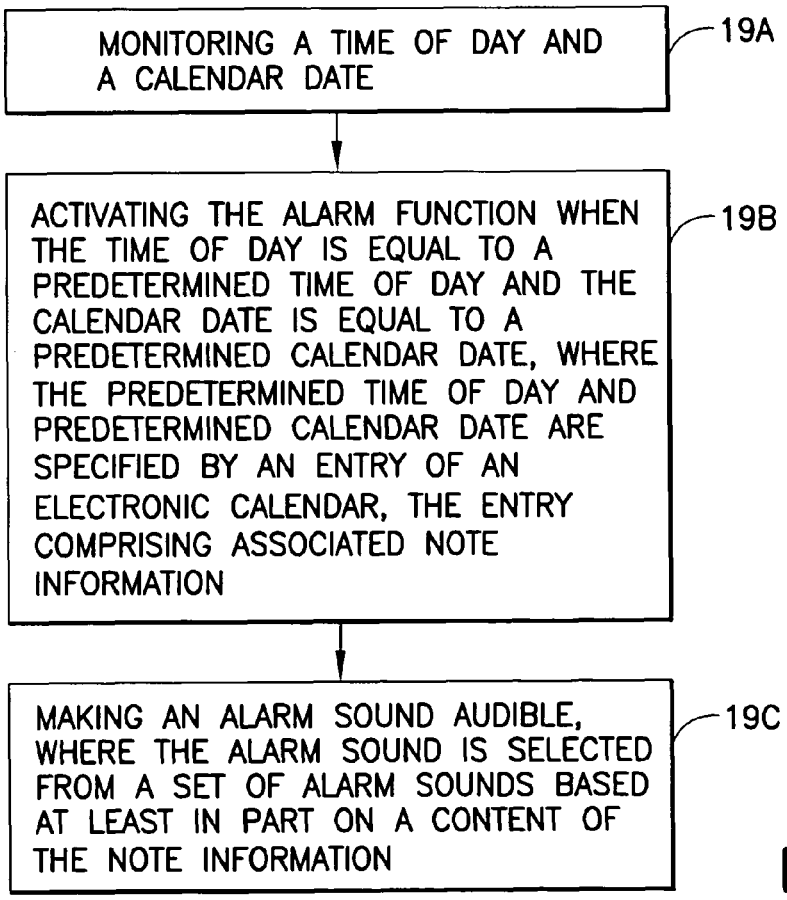

As can thus be appreciated, the exemplary embodiments of this invention also encompass a method, computer program stored in a memory, and an apparatus that provide, as in FIG. 19, (Block 19A) monitoring a time of day and a calendar date; (Block 19B) activating an alarm function when the time of day is equal to a predetermined time of day and the calendar date is equal to a predetermined calendar date, where the predetermined time of day and predetermined calendar date are specified by an entry of an electronic calendar, the entry comprising associated note information; and (Block 19C) making an alarm sound audible, where the alarm sound is selected from a set of alarm sounds based at least in part on a content of the note information.

In the foregoing method, computer program and apparatus, where individual members of the set of alarm sounds comprise digital audio data and associated metadata, and where the alarm sound is selected in accordance with a relationship between at least a part of the metadata and at least a part of the content of the note information.

Figure 15:
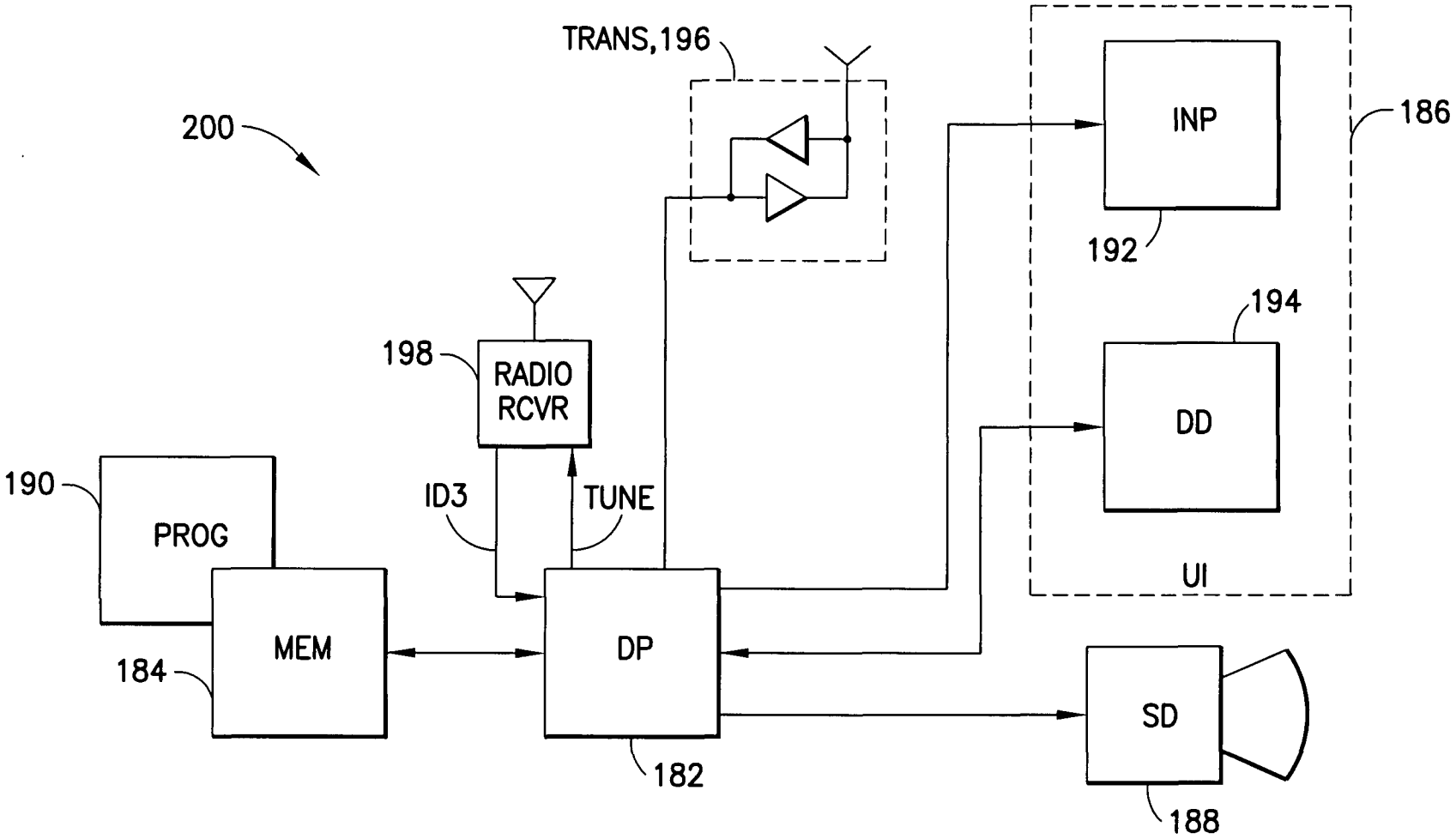

In another exemplary further embodiment, and referring to FIG. 15, if the source for the alarm sound is broadcast radio the device 200 may include (or be connected with) a radio receiver (RCVR) 198, such as a conventional broadcast AM/FM radio receiver or a satellite radio receiver. The PROG 190 may then be adapted to intelligently select a radio station that is currently playing a musical track which is compatible with the desired intensity level. In one example, if the received radio signal comprises ID3 tags, then the radio receiver 198 may be automatically tuned from station to station until a station is found that is currently broadcasting a song having an appropriate ID3 tag. Note that the radio RCVR 198 may be, in other embodiments, a television receiver, such as one capable of being tuned to different television stations each having different musical genres.

Figure 20:
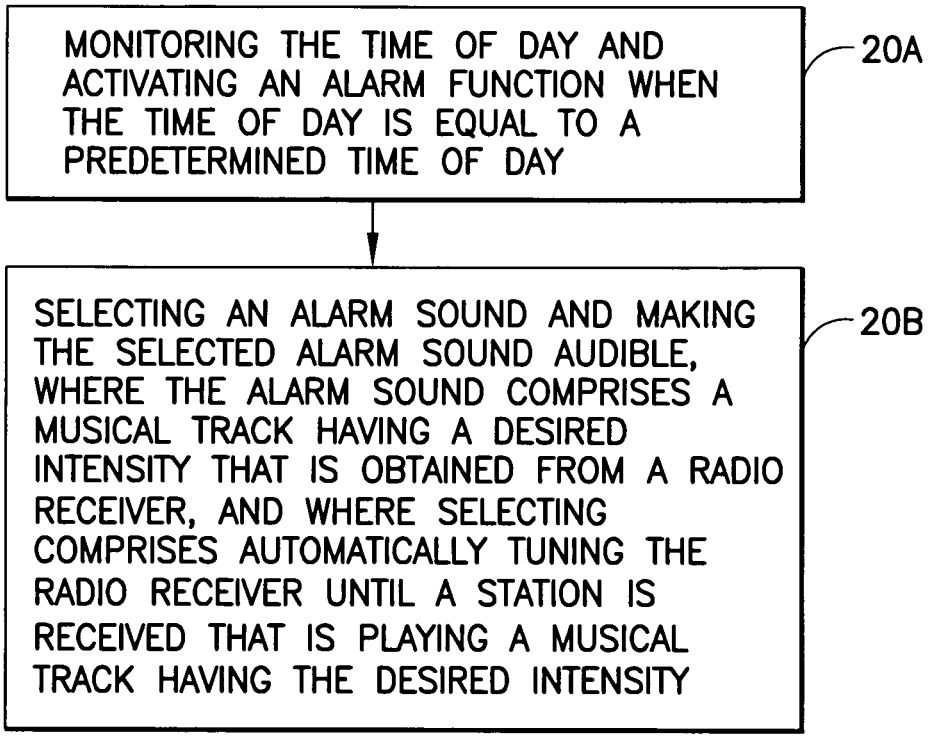

As can thus be appreciated, the exemplary embodiments of this invention also encompass a method, computer program stored in a memory, and an apparatus that provide, as in FIG. 20, (Block 20A) monitoring the time of day and activating an alarm function when the time of day is equal to a predetermined time of day; and (Block 20B) selecting an alarm sound and making the selected alarm sound audible, where the alarm sound comprises a musical track having a desired intensity that is obtained from a radio receiver, and where selecting comprises automatically tuning the radio receiver until a station is received that is playing a musical track having the desired intensity.

In the foregoing method, computer program and apparatus, where selecting further comprises examining tag information associated with a received musical track to determine if the received musical track has the desired intensity, and if not, automatically tuning the radio receiver to another radio station to receive another musical track, and repeating examining and automatically tuning until a musical track having the desired intensity is received.

In another exemplary further embodiment that may be incorporated with any of the foregoing embodiments, a single alarm sound may comprise a concatenation of two or more sounds (e.g., musical tunes). For example, a first part of the alarm sound is gentle (low energy), and after some fixed or variable number of seconds the alarm sound changes to a higher intensity.

As a further refinement to the foregoing exemplary embodiments, the PROG 190 may be adapted so as to avoid playing a music track (or other stored content) which has been played recently, e.g., to avoid playing the same music track two days in a row. In this case the PROG 190 may be adapted to also store in the time tag (TT) the time/date when a particular music track is played, which may be obtained from the CLK 183, and to then check this information before selecting the associated music track to be played again. The amount of time permitted between playing music tracks may be fixed, or it may be selectable by the user.

Note that these further exemplary embodiments described in relation to FIGS. 14 and 15 may or may not include the transceiver 196. Note as well that the embodiment of FIG. 15 could be included in the embodiment of FIG. 14, whereby the content that is used at any given time may be downloaded music files stored in the memory 184 or received broadcast radio (or television) stations. Note in this regard that if the broadcast radio receiver 198 is being used as the source of the content, and if an appropriate music file cannot be identified within some predetermined amount of time, then the PROG 190 may revert to using one of the musical tracks stored as the content 184A in the memory 180.

The various blocks shown in FIGS. 16-20 may be viewed as method steps, and/or as operations that result from operation of computer program code, and/or as a plurality of coupled logic circuit elements constructed to carry out the associated function(s).

In general, the various embodiments may be implemented in hardware or special purpose circuits, software, logic or any combination thereof. For example, some aspects may be implemented in hardware, while other aspects may be implemented in firmware or software which may be executed by a controller, microprocessor or other computing device, although exemplary embodiments of the invention are not limited thereto. While various aspects of the exemplary embodiments of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

Exemplary embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention.

Furthermore, some of the features of the exemplary embodiments of this invention could be used to advantage without the corresponding use of other features. As such, the foregoing description should be considered as merely illustrative of the principles of the invention, and not in limitation thereof.

What is claimed is:

1. A computer implemented method, comprising:

storing data descriptive of a plurality of alarm sounds received from at least one source of alarm sounds, each of the plurality of received alarm sounds corresponding to a different stored digital audio file, each stored digital audio file having a stored time tag associated therewith, the stored time tag indicating a time when the associated digital audio file was stored, the stored data forming a set of alarm sounds;

selecting from the set of alarm sounds an alarm sound corresponding to a most recently stored digital audio file, based on the associated time tags; and playing the selected alarm sound using a sound device.

2. The computer implemented method of claim 1, wherein the set of alarm sounds comprises a database comprising received sound data.

3. The computer implemented method of claim 1, where a plurality of digital audio files are played in succession in an order determined by their respective stored time tags such that a digital audio file that is currently selected to be played is one received earlier in time than a digital audio file that was last selected to be played.

4. The computer implemented method of claim 1, wherein at least one of the digital audio files comprises an mp3 file.

5. The computer implemented method of claim 1, wherein the received sound data comprise a digital audio file having ID3 tag information.

6. A non-transitory computer-readable memory that stores program instructions, the execution of which result in operations that comprise:

storing data descriptive of a plurality of alarm sounds received from at least one source of alarm sounds, each of the plurality of received alarm sounds corresponding to a different stored digital audio file, each stored digital audio file having a stored time tag associated therewith, the stored time tag indicating a time when the associated digital audio file was stored, the stored data forming a set of alarm sounds;

selecting from the set of alarm sounds an alarm sound corresponding to a most recently stored digital audio file, based on the associated time tags; and playing the selected alarm sound using a sound device.

7. The computer-readable memory of claim 6, wherein the set of alarm sounds comprises a database comprising received sound data.

8. The computer-readable memory of claim 6, wherein at least one of the digital audio files comprises an mp3 file.

9. The computer-readable memory of claim 6, wherein the received sound data comprise a digital audio file having ID3 tag information.

10. The computer-readable memory of claim 6, embodied as part of an apparatus that comprises wireless communication circuitry and a controller configured to execute the program instructions, and where at least some of the data is received from a remote source via the wireless communication circuitry.

11. An apparatus, comprising:

a controller configured with a memory to store data descriptive of a plurality of alarm sounds received from at least one source of alarm sounds, the stored data forming each of the plurality of received alarm sounds corresponding to a different stored digital audio file, each stored digital audio file having a stored time tag associated therewith, the stored time tag indicating a time when the associated digital audio file was stored, the stored data forming a set of alarm sounds;

said controller further configured to select from the set of alarm sounds an alarm sound corresponding to a most recently stored digital audio file, based on the associated time tags, and to play the selected alarm using a sound device.

12. The apparatus of claim 11, wherein the set of alarm sounds comprises a database comprising received sound data.

13. The apparatus of claim 11, wherein at least one of the digital audio files comprises an mp3 file.

14. The apparatus of claim 11, wherein the received sound data comprise a digital audio file having ID3 tag information.

15. The apparatus of claim 11, further comprising wireless communication circuitry through which at least some of the data is received from a remote source.

* * * * *